US008948681B2

(12) United States Patent
Furuya et al.

(10) Patent No.: US 8,948,681 B2
(45) Date of Patent: Feb. 3, 2015

(54) IMAGE FORMING APPARATUS AND LENGTH MEASURING DEVICE

(75) Inventors: Takao Furuya, Kanagawa (JP); Yoshinari Iwaki, Kanagawa (JP); Minoru Ohshima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 571 days.

(21) Appl. No.: 13/095,346

(22) Filed: Apr. 27, 2011

(65) Prior Publication Data

US 2012/0141147 A1 Jun. 7, 2012

(30) Foreign Application Priority Data

Dec. 7, 2010 (JP) ..... 2010-272870

(51) Int. Cl.
*G03G 15/00* (2006.01)

(52) U.S. Cl.
CPC ..... *G03G 15/6529* (2013.01); *G03G 15/6594* (2013.01); *G03G 2215/00628* (2013.01); *G03G 2215/00662* (2013.01); *G03G 2215/00734* (2013.01)
USPC ..... 399/397; 399/370; 399/371; 399/376; 399/389; 399/405; 399/401; 399/394; 271/3.17; 271/291; 271/258.01; 271/265.01; 271/265.03

(58) Field of Classification Search
CPC ..... B41J 11/24; B41J 19/02; B41J 33/52; G03G 2215/00734; G03G 2215/00628; G01B 21/06; G01B 5/02; B65H 7/02
USPC ..... 399/370, 371, 376, 389, 16, 405, 397, 399/401, 394; 271/3.17, 291, 258.01, 271/265.01–265.03; 400/565, 566, 608.1, 400/617; 33/734, 772, 740, 737, 773
See application file for complete search history.

(56) References Cited

U.S. PATENT DOCUMENTS

| | | | | |
|---|---|---|---|---|
| 3,197,137 | A * | 7/1965 | Watson | 235/103.5 R |
| 4,753,433 | A * | 6/1988 | Rodi et al. | 271/263 |
| 4,849,915 | A * | 7/1989 | Worsley et al. | 702/163 |
| 5,140,157 | A * | 8/1992 | Ohshima et al. | 250/235 |
| 5,373,363 | A * | 12/1994 | Kobayashi | 356/634 |
| 5,430,665 | A * | 7/1995 | Jin et al. | 702/163 |
| 5,983,066 | A * | 11/1999 | Abe et al. | 399/394 |
| 6,621,997 | B2 * | 9/2003 | Chung | 399/122 |

(Continued)

FOREIGN PATENT DOCUMENTS

JP A-2005-112543 4/2005

*Primary Examiner* — Matthew G Marini
*Assistant Examiner* — Quang X Nguyen
(74) *Attorney, Agent, or Firm* — Oliff PLC

(57) ABSTRACT

An image forming apparatus includes an image forming unit forming an image on a recording sheet; a transport unit transporting the recording sheet; a support surface supporting the recording sheet; a rotating member having an outer peripheral surface pressed against the support surface and rotationally following the recording sheet when the recording sheet passes through between the support surface and the outer peripheral surface; an ascertaining unit ascertaining a length of the recording sheet on the basis of an amount of rotation of the rotating member; and a restricting unit restricting a movement of the rotating member that moves toward the support surface after the recording sheet passes through between the support surface and the outer peripheral surface, the restricting unit preventing the outer peripheral surface, which comes into contact with the recording sheet, and the support surface from coming into contact with each other.

14 Claims, 16 Drawing Sheets

(56) References Cited

U.S. PATENT DOCUMENTS

| | | | | |
|---|---|---|---|---|
| 7,740,241 | B2 * | 6/2010 | Itoh et al. | 271/262 |
| 7,896,342 | B2 * | 3/2011 | Tsukamoto et al. | 271/265.04 |
| 2002/0039507 | A1 * | 4/2002 | Kawasumi et al. | 399/388 |
| 2007/0222144 | A1 * | 9/2007 | Inui et al. | 271/291 |
| 2008/0197563 | A1 * | 8/2008 | Furuya et al. | 271/265.01 |
| 2010/0232855 | A1 * | 9/2010 | Kawachi et al. | 399/401 |
| 2010/0247115 | A1 * | 9/2010 | Ohshima et al. | 399/16 |
| 2010/0258997 | A1 * | 10/2010 | Lee et al. | 271/3.16 |
| 2011/0058828 | A1 * | 3/2011 | Tsukamoto et al. | 399/45 |
| 2011/0076077 | A1 * | 3/2011 | Morofuji et al. | 399/389 |

* cited by examiner

IMAGE FORMING APPARATUS AND LENGTH MEASURING DEVICE

CROSS-REFERENCE TO RELATED APPLICATIONS

This application is based on and claims priority under 35 USC 119 from Japanese Patent Application No. 2010-272870 filed Dec. 7, 2010.

BACKGROUND

(i) Technical Field

The present invention relates to image forming apparatuses and length measuring devices.

SUMMARY

According to an aspect of the invention, there is provided an image forming apparatus including an image forming unit, a transport unit, a support surface, a rotating member, an ascertaining unit, and a restricting unit. The image forming unit forms an image on a recording sheet. The transport unit transports the recording sheet on which the image is formed by the image forming unit. The support surface supports the recording sheet transported by the transport unit. The rotating member has an outer peripheral surface pressed against the support surface and rotationally follows the recording sheet when the recording sheet passes through between the support surface and the outer peripheral surface. The ascertaining unit ascertains a length of the recording sheet on the basis of an amount of rotation of the rotating member. The restricting unit restricts a movement of the rotating member that moves toward the support surface after the recording sheet passes through between the support surface and the outer peripheral surface of the rotating member. Moreover, the restricting unit prevents the outer peripheral surface, which comes into contact with the recording sheet, of the rotating member and the support surface from coming into contact with each other.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below in detail with reference to the attached drawings.

Figure 1:
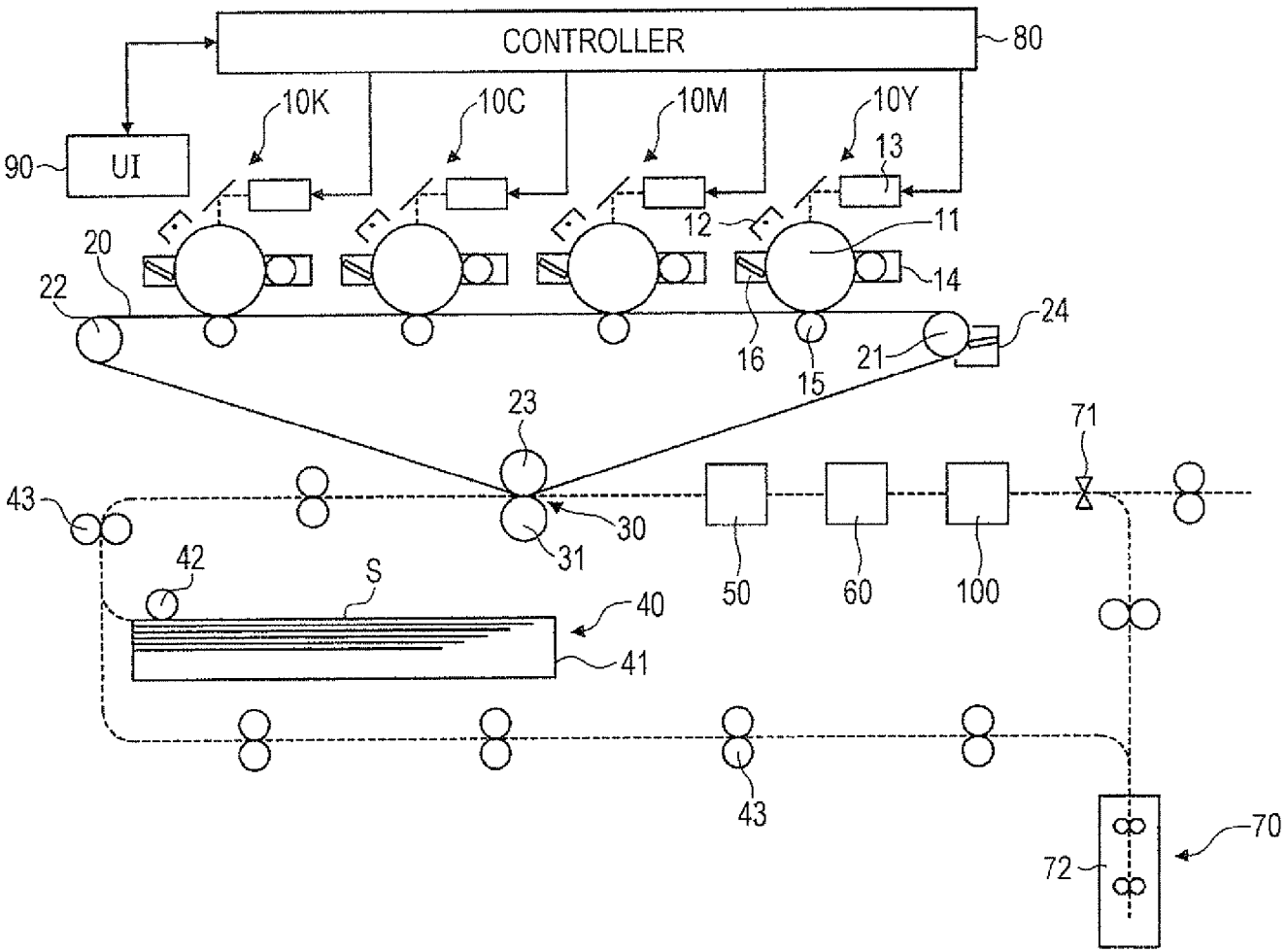
FIG. 1 is a schematic configuration diagram illustrating an example of an image forming apparatus to which an exemplary embodiment is applied.

FIG. 1 is a schematic configuration diagram illustrating an example of an image forming apparatus to which an exemplary embodiment is applied. The image forming apparatus shown in FIG. 1 has a so-called tandem-type configuration and includes, for example, multiple image forming units 10 (10Y, 10M, 10C, and 10K) that form toner images of respective color components by electrophotography.

The image forming apparatus includes an intermediate transfer belt 20 onto which the toner images of the respective color components formed by the image forming units 10 are sequentially transferred (first-transferred) and that bears the toner images, and a second-transfer device 30 that collectively transfers (second-transfers) the toner images on the intermediate transfer belt 20 onto a recording sheet S serving as an example of a transported object. Furthermore, the image forming apparatus includes a recording-sheet feeding device 40 that feeds the recording sheet S toward the second-transfer device 30, a fixing device 50 that fixes the image second-transferred by the second-transfer device 30 onto the recording sheet S, and a cooling device 60 that cools the recording sheet S on which the image is fixed. The image forming units 10, the intermediate transfer belt 20, the second-transfer device 30, etc. can be defined as an image forming section that forms an image on the recording sheet S.

Each of the image forming units 10 includes a rotatably-attached photoconductor drum 11, a charging device 12 that is provided on the periphery of the photoconductor drum 11 and that electrostatically charges the photoconductor drum 11, an exposure device 13 that exposes the photoconductor drum 11 to light so as to write an electrostatic latent image thereon, a developing device 14 that makes the electrostatic latent image on the photoconductor drum 11 into a visible image by using toner, a first-transfer device 15 that transfers the toner image of the corresponding color component formed on the photoconductor drum 11 onto the intermediate transfer belt 20, and a drum cleaning device 16 that removes residual toner from the photoconductor drum 11. In the description below, the image forming units 10 will be referred to as a yellow-image forming unit 10Y, a magenta-image forming unit 10M, a cyan-image forming unit 10C, and a black-image forming unit 10K.

The intermediate transfer belt 20 is stretched around three roller members 21 to 23 and is provided in a rotatable manner.

Among the three roller members 21 to 23, the roller member 22 is configured to drive the intermediate transfer belt 20. The roller member 23 is disposed opposite a second transfer roller 31 with the intermediate transfer belt 20 interposed therebetween, and the second transfer roller 31 and the roller member 23 constitute the second-transfer device 30. A belt cleaning device 24 that removes residual toner from the intermediate transfer belt 20 is disposed opposite the roller member 21 with the intermediate transfer belt 20 interposed therebetween. The recording-sheet feeding device 40 includes a recording-sheet accommodating portion 41 that accommodates the recording sheet S, and a feed roller 42 that feeds and transports the recording sheet S accommodated in the recording-sheet accommodating portion 41.

Multiple transport rollers 43 are provided on a transport path of the recording sheet S fed by the recording-sheet feeding device 40. The material used for the recording sheet S may be various kinds of paper materials, or a resinous material used for, for example, an OHP sheet, or the recording sheet S may be a sheet formed by coating the surface of paper with a resin film. The fixing device 50 includes a heating source that heats the recording sheet S. In this exemplary embodiment, an image transferred on the recording sheet S is fixed onto the recording sheet S by applying heat and pressure onto the image. The cooling device 60 has a function of cooling the recording sheet S heated by the fixing device 50. For example, the cooling device 60 cools the recording sheet S by making the recording sheet S pass through between two metallic rollers that are disposed so as to nip the recording sheet S.

In addition to being capable of forming an image on one face of the recording sheet S fed from the recording-sheet feeding device 40, the image forming apparatus according to this exemplary embodiment is also capable of forming another image on the other face of the recording sheet S by inverting the recording sheet S having the image formed on one face thereof. More specifically, the image forming apparatus includes an inversion transport mechanism 70 that inverts the front and rear faces and the leading and trailing edges, in the transport direction, of the recording sheet S having passed the fixing device 50 and the cooling device 60 and then returns the recording sheet S again to the second-transfer device 30.

The inversion transport mechanism 70 includes a switch device 71 that is provided downstream of the cooling device 60 in the transport direction of the recording sheet S and that switches the traveling direction of the recording sheet S between a transport path for discharging the recording sheet S outward from the image forming apparatus and a transport path for inverting the recording sheet S. The inversion transport mechanism 70 further includes an inverting device 72. The inverting device 72 is provided within the transport path for inverting the recording sheet S and is configured to invert the front and rear faces of the recording sheet S traveling toward the second-transfer device 30. The transport rollers 43 are also provided in the transport path for inverting the recording sheet S.

Furthermore, in the image forming apparatus according to this exemplary embodiment, a measuring device 100 (an example of a length measuring device) that measures the length of the recording sheet S in the transport direction is provided downstream of the cooling device 60 in the transport direction of the recording sheet S and upstream of the switch device 71 in the transport direction of the recording sheet S. In other words, the measuring device 100 that measures the length of the recording sheet S transported from the cooling device 60 by the transport rollers 43 functioning as a transport unit is provided. The installation position of the measuring device 100 is not limited to this area and may alternatively be located in the transport path for inverting the recording sheet S. Furthermore, the image forming apparatus according to this exemplary embodiment is provided with a controller 80 that controls the operation of the devices and the components constituting the image forming apparatus, and a user interface (UI) 90 that outputs a command received from a user to the controller 80 and shows the command received from the controller 80 to the user via a screen (not shown).

Figure 2:
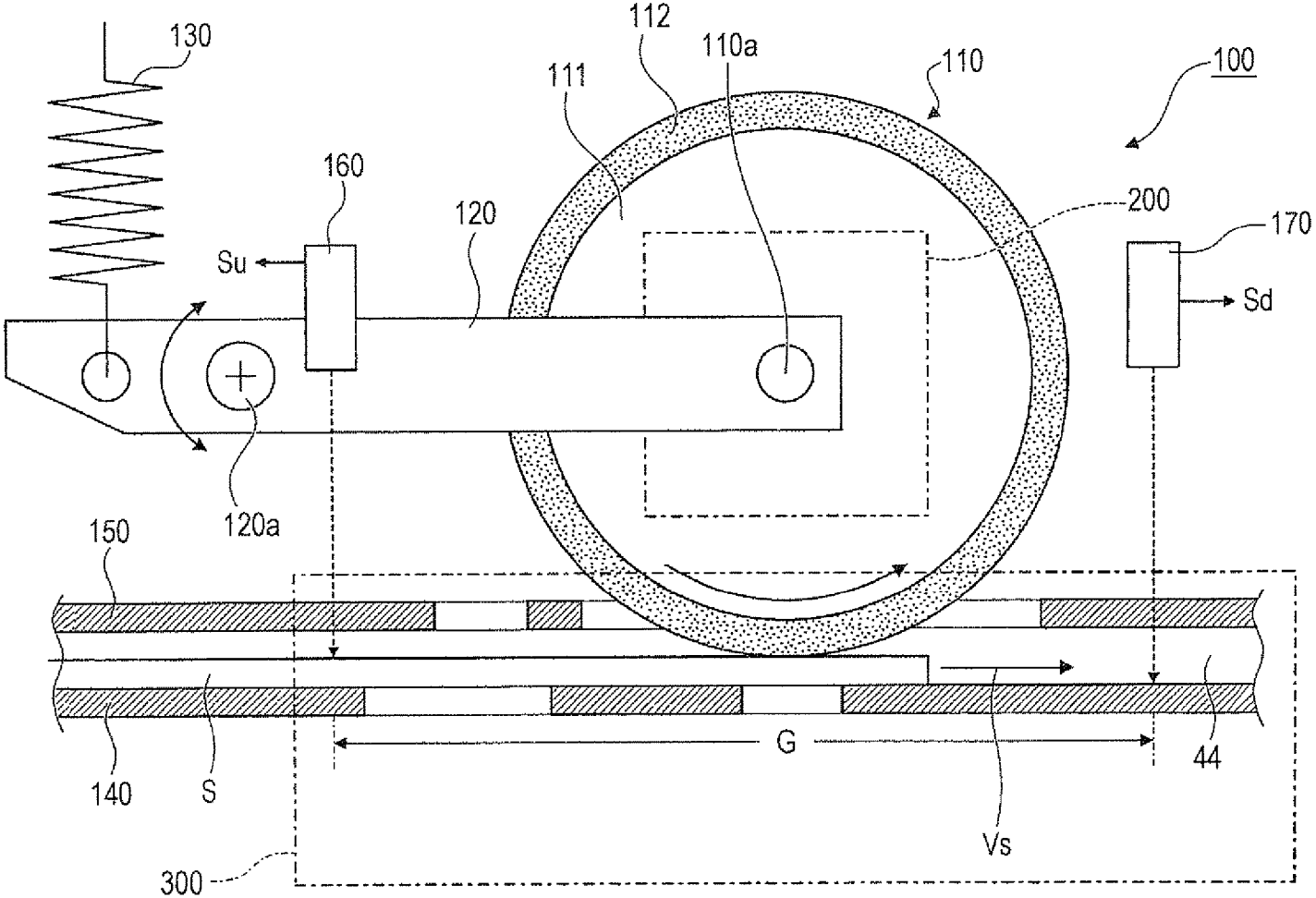
FIG. 2 is a schematic configuration diagram illustrating an example of a measuring device.

FIG. 2 is a schematic configuration diagram illustrating an example of the measuring device 100.

The measuring device 100 includes a measuring roller 110 (an example of a rotating member) that rotates about a rotary shaft 110*a* above a transport path 44, and a rotation-amount detecting device 200 that detects the amount of rotation of the measuring roller 110 attached to the rotary shaft 110*a* of the measuring roller 110.

The measuring roller 110 includes a roller body 111. The roller body 111 has a columnar shape with a circular cross section, and is composed of resin or metal, such as aluminum. Furthermore, the measuring roller 110 includes a surface layer 112 made of an elastic member, such as rubber, and formed around an outer peripheral surface of the roller body 111. In this exemplary embodiment, the surface layer 112 is made of an elastic member, such as rubber, and the surface of the roller body 111 is made to be more slidable than the surface layer 112. In other words, the surface of the roller body 111 has a coefficient of friction that is smaller than the coefficient of friction of the surface of the surface layer 112. Therefore, slippage against the recording sheet S occurs less when the surface layer 112 comes into contact with the recording sheet S, as compared with when the surface of the roller body 111 comes into contact with the recording sheet S. Furthermore, in this exemplary embodiment, the roller body 111 has greater abrasion resistance than the surface layer 112.

The rotary shaft 110*a* of the measuring roller 110 is attached to the roller body 111. The measuring device 100 includes a pivot arm 120 that pivots about a pivot shaft 120*a* extending in the same direction as the rotary shaft 110*a* above the transport path 44. The pivot shaft 120*a* is disposed upstream of the rotary shaft 110*a* of the measuring roller 110 in the transport direction of the recording sheet S. The pivot shaft 120*a* is attached to a housing (not shown) of the measuring device 100. In the state shown in FIG. 2, the pivot arm 120 extends in the transport direction of the recording sheet S, and a downstream end of the pivot arm 120, as viewed in the transport direction of the recording sheet S, has the rotary shaft 110*a* of the measuring roller 110 attached thereto.

In addition, an upstream end of the pivot arm 120, as viewed in the transport direction of the recording sheet S, has one end of a coil spring 130 attached thereto. The other end of the coil spring 130 is attached to a supporter (not shown) provided opposite the transport path 44 with the pivot arm 120 interposed therebetween. In FIG. 2, the coil spring 130 is in a stretched state such that a force that rotates the pivot arm 120 clockwise about the pivot shaft 120*a* is applied from the coil spring 130 to the pivot arm 120. Consequently, since the force that rotates the pivot arm 120 clockwise is applied to the pivot arm 120 in the measuring device 100 in this exemplary embodiment, the outer peripheral surface of the measuring roller 110 is pressed toward the transport path 44 (and the recording sheet S transported within the transport path 44). Moreover, in this exemplary embodiment, the outer peripheral surface of the measuring roller 110 comes into contact with the recording sheet S when the recording sheet S passes through between a lower guide member 140, to be described below, and the measuring roller 110, whereby the measuring roller 110 rotationally follows the recording sheet S.

The transport path 44 that transports the recording sheet S is formed by the lower guide member 140 and an upper guide member 150 that are disposed at opposite positions separated by a gap having a predetermined dimension. The lower guide member 140 and the upper guide member 150 each have a plate-like shape. Moreover, each of the lower guide member 140 and the upper guide member 150 has multiple openings (through-holes). The lower guide member 140 and the upper guide member 150 have a function of guiding the transported recording sheet S and regulating the moving direction thereof. In this exemplary embodiment, the recording sheet S is transported within the transport path 44 while being in contact with the lower guide member 140, and the upper guide member 150 restricts an upper movement of the recording sheet S so as to prevent the recording sheet S from being displaced upward. The upper surface of the lower guide member 140 (i.e., the surface facing the upper guide member 150) can be defined as a support surface that supports the transported recording sheet S.

Furthermore, the measuring device 100 is provided with an upstream-side detection sensor 160 (an example of a second detector) at the upstream side, in the transport direction of the recording sheet S, of an area where the measuring roller 110 and the recording sheet S (or the lower guide member 140) come into contact with each other. The upstream-side detection sensor 160 detects that the leading edge or the trailing edge of the recording sheet S in the transport direction has passed. Moreover, a downstream-side detection sensor 170 (an example of a first detector) that detects that the leading edge or the trailing edge of the recording sheet S in the transport direction has passed is provided at the downstream side, in the transport direction of the recording sheet S, of the area where the measuring roller 110 and the recording sheet S (or the lower guide member 140) come into contact with each other.

In this exemplary embodiment, each of the upstream-side detection sensor 160 and the downstream-side detection sensor 170 is formed of a photo-electronic sensor constituted of a light-emitting diode (LED) and a photo-sensor, and optically detects that the transported recording sheet S has passed a detection position. In order to allow for detection of the recording sheet S by the upstream-side detection sensor 160 and the downstream-side detection sensor 170, the upper guide member 150 is provided with openings (not shown). The upstream-side detection sensor 160 is configured to output an upstream-side edge signal Su, and the downstream-side detection sensor 170 is configured to output a downstream-side edge signal Sd.

Furthermore, the measuring device 100 in this exemplary embodiment is provided with a moving mechanism 300 (which will be described in detail later) that moves the measuring roller 110 away from the lower guide member 140 as well as toward the lower guide member 140. In the description below, a distance between the detection position of the recording sheet S by the upstream-side detection sensor 160 and the detection position of the recording sheet S by the downstream-side detection sensor 170 will be referred to as a gap G. Furthermore, in this exemplary embodiment, the recording sheet S is transported within the transport path 44 at a predetermined speed, and this predetermined speed of the recording sheet S will be referred to as a recording-sheet transport speed Vs. The moving mechanism 300 in this exemplary embodiment can be defined as a restricting unit that restricts the movement of the measuring roller 110 that moves toward the lower guide member 140 after the recording sheet S passes.

Figure 3:
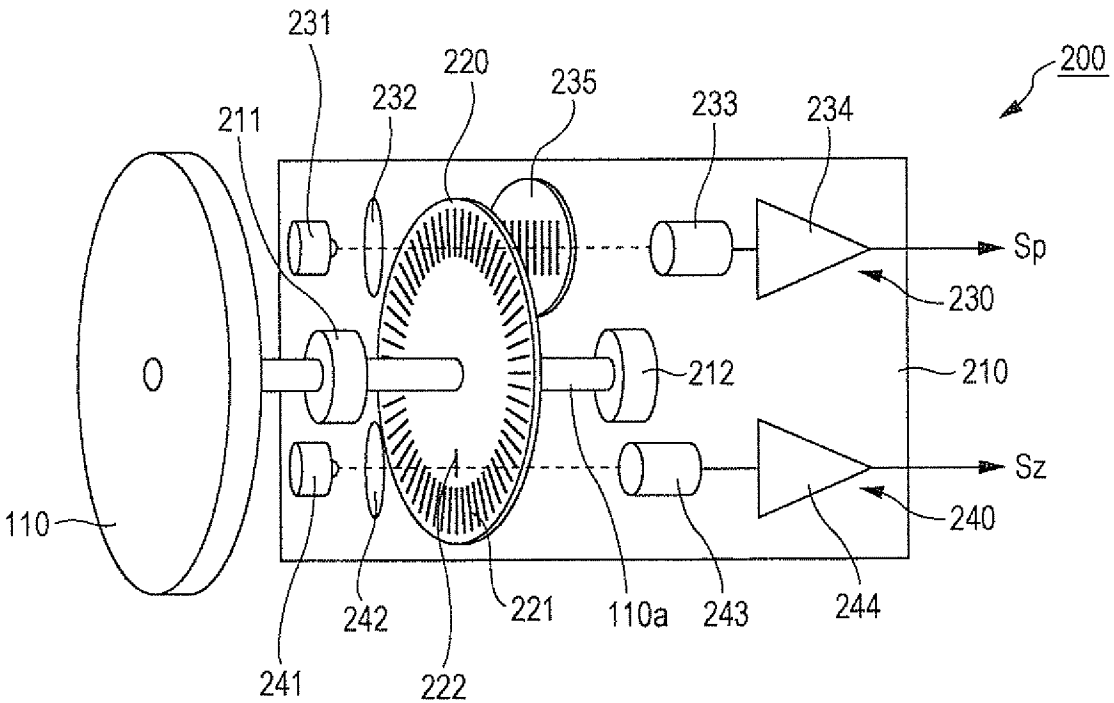
FIG. 3 is a schematic configuration diagram illustrating an example of a rotation-amount detecting device that is provided in the measuring device shown in FIG. 2 and that detects the amount of rotation of a measuring roller via a rotary shaft.

FIG. 3 is a schematic configuration diagram illustrating an example of the rotation-amount detecting device 200 that is provided in the measuring device 100 shown in FIG. 2 and that detects the amount of rotation of the measuring roller 110 via the rotary shaft 110*a*. The rotation-amount detecting device 200 is provided so as to share the rotary shaft 110*a* with the measuring roller 110 at one end thereof, and is configured to rotate together with the measuring roller 110 when the pivot arm 120 shown in FIG. 2 pivots.

The rotation-amount detecting device 200 has, for example, a rectangular parallelepiped shape, and includes a housing 210 into which the rotary shaft 110*a* of the measuring roller 110 extends, two bearings 211 and 212 that are fixed to the housing 210 and rotatably support the rotary shaft 110*a* within the housing 210, and a circular slit disk 220 attached to the rotary shaft 110*a* and having multiple radial slits. The slit disk 220 is composed of, for example, glass. The slit disk 220 is provided with multiple first slits 221 arranged at equal intervals in the circumferential direction and a single second slit 222 formed within the first slits 221 in the radial direction. The first slits 221 and the second slit 222 extend completely through the slit disk 220.

The rotation-amount detecting device 200 further includes a first slit detector 230 that detects that the first slits 221 have passed when the slit disk 220 rotates as the measuring roller 110 and the rotary shaft 110*a* rotate, and a second slit detector 240 that detects that the second slit 222 has passed. The first slit detector 230 includes a first light emitter 231 that emits light toward a peripheral area of the slit disk 220, that is, an area where the first slits 221 are formed, a first lens 232 that condenses the light emitted from the first light emitter 231 toward the slit disk 220, a fixed slit 235 that is disposed on an optical axis of the light emitted from the first light emitter 231 and passing through the first slits 221, a first light receiver 233 that receives the light passing the first slits 221 and the fixed slit 235, and a first amplifier 234 that amplifies an output signal from the first light receiver 233.

On the other hand, the second slit detector 240 includes a second light emitter 241 that emits light toward an area where the single second slit 222 is formed, which is provided inward of the peripheral area of the slit disk 220, a second lens 242 that condenses the light emitted from the second light emitter 241 toward the slit disk 220, a second light receiver 243 that receives the light emitted from the second light emitter 241 and passing through the second slit 222, and a second amplifier 244 that amplifies an output signal from the second light receiver 243. The first light emitter 231 and the second light emitter 241 are each constituted of, for example, a light-emitting diode (LED), and the first light receiver 233 and the second light receiver 243 are each constituted of, for example, a photodiode (PD).

In the rotation-amount detecting device 200, the rotation of the slit disk 220 occurring due to the rotation of the measuring roller 110 causes the light emitted from the first light emitter 231 to be temporally split by the first slits 221 provided in the slit disk 220. Then, the first light receiver 233 intermittently receives the light passing through the first slits 221 and the fixed slit 235 and outputs a pulse waveform as an output signal in accordance with the timing of the received light. Subsequently, the first amplifier 234 outputs a phase signal Sp obtained by amplifying the output signal to the controller 80 (see FIG. 1) provided in the image forming apparatus. On the other hand, the second light receiver 243 receives the light passing through the second slit 222 every time the measuring roller 110 makes one rotation, and outputs a pulse waveform as an output signal in accordance with the timing of the received light. The second amplifier 244 outputs a Z-phase signal Sz obtained by amplifying the output signal to the controller 80.

Although a so-called incremental-type rotary encoder is used as the rotation-amount detecting device 200 in this exemplary embodiment, the incremental-type rotary encoder may be changed to another type where appropriate so long as the device is capable of measuring the amount of rotation of the measuring roller 110 in units of a value smaller than one rotation ($2\pi$(rad)). An example of such a device includes an absolute-type rotary encoder. Furthermore, although the rotation-amount detecting device 200 utilizes light variations in this exemplary embodiment, the rotation-amount detecting device 200 may alternatively be of a type that utilizes, for example, magnetic variations.

Figure 4:
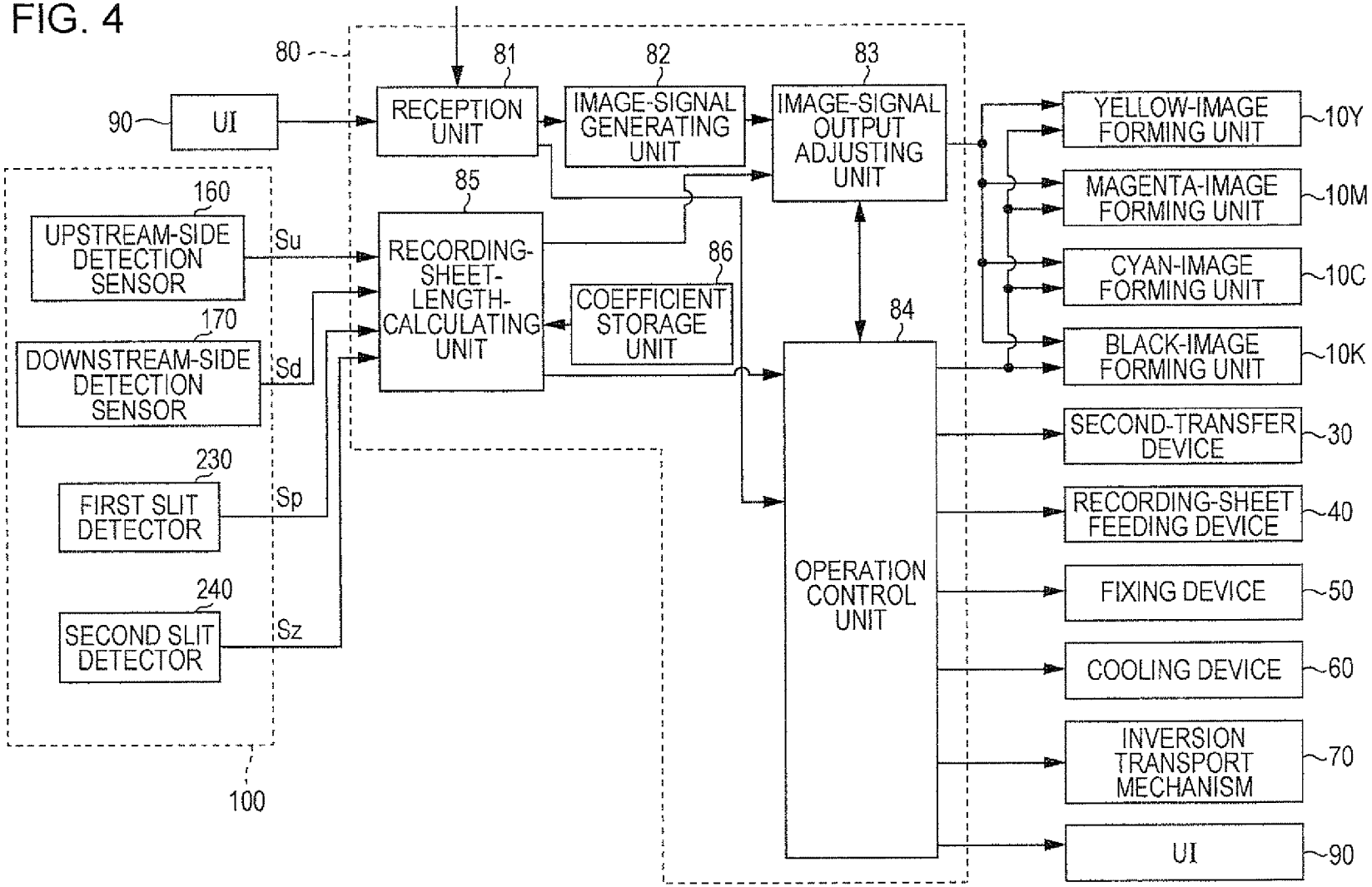
FIG. 4 is a block diagram illustrating a configuration example of a controller shown in FIG. 1.

FIG. 4 is a block diagram illustrating a configuration example of the controller 80 shown in FIG. 1.

The controller 80 includes a reception unit 81 that receives a command output from the UI 90 or from an external device (not shown) connected to the image forming apparatus, and an image-signal generating unit 82 that generates image signals of yellow, magenta, cyan, and black colors on the basis of image data sent together with a print command when the print command is received via the reception unit 81. The controller 80 further includes an image-signal output adjusting unit 83 that adjusts the timing for outputting the image signals of the respective colors generated by the image-signal generating unit 82 to the respective image forming units 10 (more specifically, the exposure devices 13 provided in the image forming units 10) and that also adjusts the magnification, in a sub-scanning direction (i.e., a direction corresponding to the transport direction of the recording sheet S), of the image signals of the respective colors generated by the image-signal generating unit 82. Furthermore, the controller 80 includes an operation control unit 84 that controls the operation of each of the components constituting the image forming apparatus, such as the image forming units 10 (10Y, 10M, 10C, and 10K), the second-transfer device 30, the recording-sheet feeding device 40, the fixing device 50, the cooling device 60, and the inversion transport mechanism 70.

The controller 80 in this exemplary embodiment further includes a recording-sheet-length calculating unit 85 that calculates (ascertains) a recording-sheet length L, which is the length in the transport direction of the recording sheet S passing the measuring device 100, on the basis of various signals input from the measuring device 100. The various signals input to the recording-sheet-length calculating unit 85 include the upstream-side edge signal Su input from the upstream-side detection sensor 160, the downstream-side edge signal Sd input from the downstream-side detection sensor 170, the phase signal Sp input from the first slit detector 230, and the Z-phase signal Sz input from the second slit detector 240. The recording-sheet-length calculating unit 85 functions as a part of an ascertaining unit that ascertains the length of the recording sheet S.

Furthermore, the controller 80 includes a coefficient storage unit 86 that stores various coefficients to be used in the recording-sheet-length calculating unit 85 for calculating the recording-sheet length L. Specifically, the coefficient storage unit 86 stores the gap G (see FIG. 2) in the measuring device 100, the recording-sheet transport speed Vs (see FIG. 2) preliminarily set in accordance with, for example, the type of recording sheet S used, and a unit moving distance X indicating how much the periphery of the measuring roller 110 is moved per single pulse count of the phase signal Sp. The recording-sheet length L calculated by the measuring device 100 is output to the image-signal output adjusting unit 83 so as to be used for adjusting the output of the image signals. The recording-sheet length L is also output to the operation control unit 84 so as to be used for controlling the operation of the components constituting the image forming apparatus. The controller 80 includes, for example, a central processing unit (CPU), a read-only memory (ROM), and a random access memory (RAM). The CPU performs processing while exchanging data with the RAM in accordance with a program preliminarily stored in the ROM. Accordingly, the functional components described above are provided.

Figure 5:
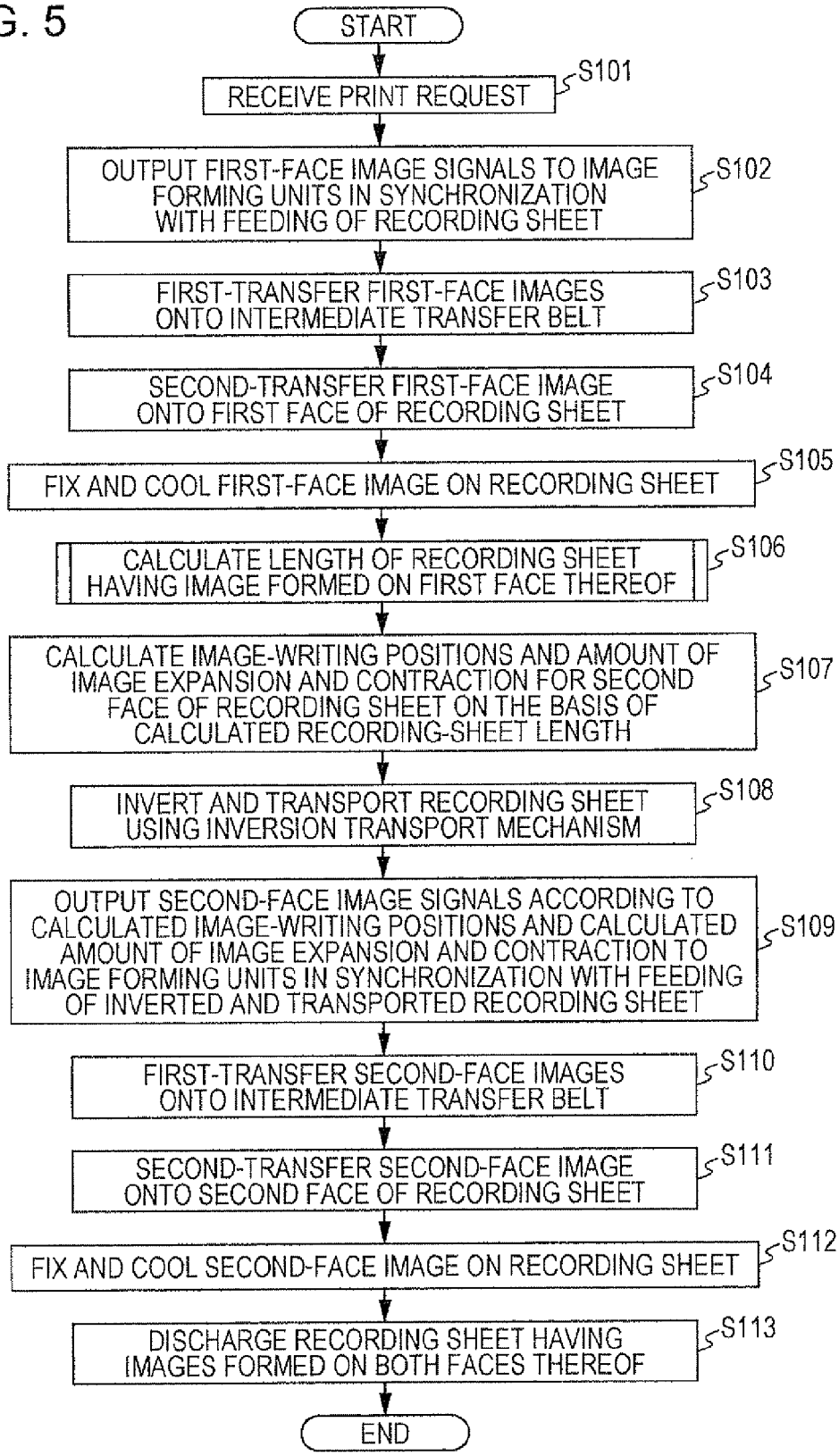
FIG. 5 is a flow chart illustrating an example of the content of processing performed in the controller when images are to be formed on both faces of a recording sheet.

FIG. 5 is a flow chart illustrating an example of the content of processing performed in the controller 80 when images are to be formed on both faces of the recording sheet S. The description below will be provided with reference to FIG. 5 and FIGS. 1 to 4. When the reception unit 81 receives a print request from the UI 90 or the external device in step S101, the operation control unit 84 activates the components constituting the image forming apparatus and performs a warm-up operation. The image-signal generating unit 82 generates first-face image signals of the respective colors to be formed on the first face of the recording sheet S on the basis of input image data. Then, in step S102, the operation control unit 84 causes the recording-sheet feeding device 40 to start feeding the recording sheet S, and the image-signal output adjusting unit 83 outputs the first-face image signals of the respective colors generated by the image-signal generating unit 82 to the respective image forming units 10 (more specifically, the exposure devices 13 provided in the image forming units 10) in synchronization with the feeding of the recording sheet S.

In response to the reception of the signals, the image forming units 10 form images (i.e., toner images in this example) in accordance with the first-face image signals of the respective colors. More specifically, the operation control unit 84 rotates the photoconductor drums 11 of the image forming units 10 and makes the charging devices 12 electrostatically charge the rotating photoconductor drums 11, and subsequently exposes the photoconductor drums 11 to light beams corresponding to the first-face image signals of the respective colors from the exposure device 13, thereby forming electrostatic latent images on the photoconductor drums 11. Then, the operation control unit 84 makes the corresponding developing devices 14 for the respective colors develop the electrostatic latent images formed on the photoconductor drums 11 so as to form first-face images of the respective colors. Subsequently, in step S103, the operation control unit 84 uses the first-transfer devices 15 to sequentially first-transfer the first-face images formed on the photoconductor drums 11 onto the intermediate transfer belt 20 rotationally driven together with the photoconductor drums 11. As the intermediate transfer belt 20 is further rotated, the superimposed first-face image, obtained as the result of the first-transfer, on the intermediate transfer belt 20 is guided toward a second transfer position, which is a position where the second transfer roller 31 and the roller member 23 face each other.

The recording sheet S fed from the recording-sheet feeding device 40 is transported by the transport rollers 43 so as to reach the second transfer position. The operation control unit 84 uses the second-transfer device 30 to second-transfer the first-face image formed on the intermediate transfer belt 20 onto the first face of the recording sheet S in step S104. Subsequently, in step S105, the operation control unit 84 uses the fixing device 50 to, for example, apply heat and pressure to the recording sheet S having the image transferred on the first face thereof so as to fix the first-face image onto the recording sheet S, and then uses the cooling device 60 to cool the recording sheet S heated by the fixing device 50.

The recording sheet S with the first-face image fixed thereon is transported from the cooling device 60 to the measuring device 100. In the measuring device 100, the measuring roller 110 rotates as the recording sheet S is transported. The first slit detector 230 outputs the phase signal Sp according to the amount of rotation of the measuring roller 110. The second slit detector 240 outputs the Z-phase signal Sz according to the number of rotations of the measuring roller 110. Furthermore, as the recording sheet S is transported, the upstream-side detection sensor 160 outputs the upstream-side edge signal Su, and the downstream-side detection sensor 170 outputs the downstream-side edge signal Sd. In step S106, the recording-sheet-length calculating unit 85 uses the various signals input from the measuring device 100 and the various coefficients read from the coefficient storage unit 86 to calculate the recording-sheet length L of the recording sheet S that has passed the measuring device 100. Subsequently, the recording-sheet-length calculating unit 85 outputs the calculated recording-sheet length L to the image-signal output adjusting unit 83 and the operation control unit 84. A technique for calculating the recording-sheet length L will be described in detail later.

Subsequently, in step S107, based on the received recording-sheet length L, the image-signal output adjusting unit 83 calculates timings (i.e., image-writing positions where second images are to be written onto the photoconductor drums 11 by the exposure devices 13) for outputting second-face image signals of the respective colors generated by the image-signal generating unit 82 to the exposure devices 13 provided in the respective image forming units 10, and the magnification (i.e., the amount of expansion and contraction), in the sub-scanning direction, of the second-face image signals of the respective colors generated by the image-signal generating unit 82. In addition, the operation control unit 84 switches the switch device 71 to the transport path for inversion transport before the leading edge of the recording sheet S in the transport direction reaches the switch device 71, and inverts the front and rear faces of the recording sheet S by reversing the traveling direction of the recording sheet S transported to the inverting device 72. As a result, in step S108, the recording sheet S is inverted and transported by the inversion transport mechanism 70 toward the transfer path at the upstream side of the second-transfer device 30 in the transport direction.

Subsequently, the image-signal generating unit 82 generates second-face image signals of the respective colors to be formed on the second face of the recording sheet S on the basis of input image data. The operation control unit 84 further transports the inverted recording sheet S. In step S109, the image-signal output adjusting unit 83 adjusts the second-face image signals of the respective colors generated by the image-signal generating unit 82 in accordance with the image-writing positions and the amount of expansion and contraction calculated in step S107, and subsequently outputs the second-face image signals to the image forming units 10 (more specifically, the exposure devices 13 provided in the image forming units 10) in synchronization with the feeding of the inverted recording sheet S already having the first image recorded on the first face thereof.

In response to the reception of the signals, the image forming units 10 form images in accordance with the second-face image signals of the respective colors. More specifically, the operation control unit 84 rotates the photoconductor drums 11 of the image forming units 10 and makes the charging devices 12 electrostatically charge the rotating photoconductor drums 11, and subsequently exposes the photoconductor drums 11 to light beams corresponding to the second-face image signals of the respective colors from the exposure device 13, thereby forming electrostatic latent images on the photoconductor drums 11. Then, the operation control unit 84 makes the corresponding developing devices 14 for the respective colors develop the electrostatic latent images formed on the photoconductor drums 11 so as to form second-face images of the respective colors. Subsequently, in step S110, the operation control unit 84 uses the first-transfer devices 15 to sequentially first-transfer the second-face images formed on the photoconductor drums 11 onto the intermediate transfer belt 20 rotationally driven together with the photoconductor drums 11. As the intermediate transfer belt 20 is further rotated, the superimposed second-face image, obtained as the result of the first-transfer, on the intermediate transfer belt 20 is guided toward the second transfer position.

The inverted recording sheet S already having the first image recorded on the first face thereof is transported by the transport rollers 43 so as to reach the second transfer position again. The operation control unit 84 uses the second-transfer device 30 to second-transfer the second-face image formed on the intermediate transfer belt 20 onto the second face of the recording sheet S in step S111. Subsequently, in step S112, the operation control unit 84 uses the fixing device 50 to, for example, apply heat and pressure to the recording sheet S having the image transferred on the second face thereof so as to fix the second-face image onto the recording sheet S, and then uses the cooling device 60 to cool the recording sheet S heated by the fixing device 50. Moreover, the operation control unit 84 switches the switch device 71 to the transport path for discharging the recording sheet S outward from the image forming apparatus before the leading edge of the recording sheet S, having the images fixed on the first and second faces thereof, in the transport direction reaches the switch device 71. Thus, the recording sheet S is discharged outward from the image forming apparatus in step S113. Accordingly, the series of processes is completed.

When the image forming operation based on the above-described procedure is performed on multiple recording sheets S, a single booklet is made by binding together the multiple recording sheets S having images formed on both faces thereof. In this case, even if the recording-sheet length L varies among the multiple recording sheets S, the image forming conditions, such as the image-writing positions and the magnification in the sub-scanning direction, are adjusted on the basis of the recording-sheet length L measured by the measuring device 100. Therefore, a displacement amount in the recorded positions among the recording sheets S is reduced in the case where the booklet is of a horizontal or vertical double-page spread type, whereby a high-quality booklet is made, as compared with a case where an adjustment based on the recording-sheet length L is not performed. Although displacement of images formed on the first and second faces of the recording sheet S is reduced by adjusting the output of the second-face image signals to be supplied to the exposure devices 13 in the above description, such displacement may alternatively be reduced by, for example, performing an adjustment of the magnification in the sub-scanning direction by adjusting the rotational speed of the photoconductor drums 11 relative to the moving speed of the intermediate transfer belt 20.

The technique for calculating the recording-sheet length L of the recording sheet S in step S106 described above will now be described.

Figure 6A:
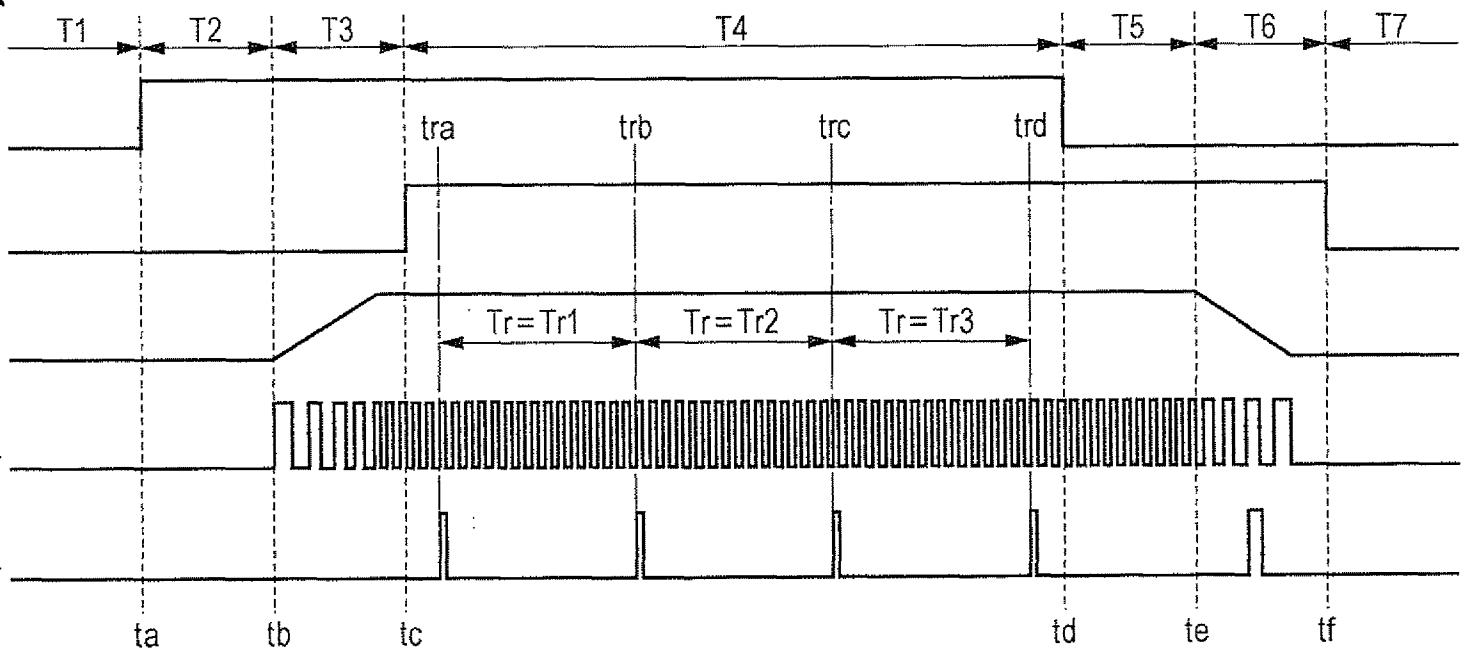
FIGS. 6A to 6C are timing charts illustrating an example of the relationship between a rolling speed of the measuring roller that rotates as the recording sheet passes and various signals output from the measuring device.
Figure 6B:
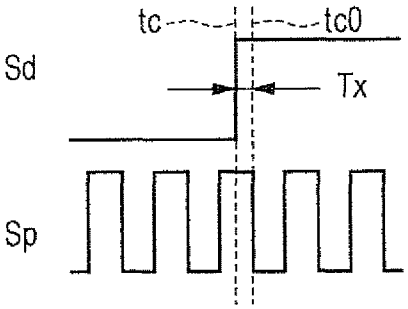
Figure 6C:
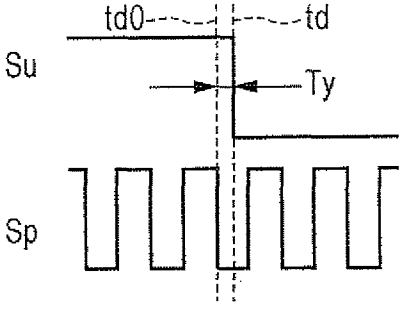

FIG. 6A is a timing chart illustrating an example of the relationship between a rolling speed Vr of the measuring roller 110 that rotates as the recording sheet S passes, the upstream-side edge signal Su output from the upstream-side detection sensor 160, the downstream-side edge signal Sd output from the downstream-side detection sensor 170, the phase signal Sp output from the first slit detector 230, and the Z-phase signal Sz output from the second slit detector 240. FIG. 6B is an enlarged view illustrating the relationship between the downstream-side edge signal Sd and the phase signal Sp before and after a third time point tc, to be described later, and FIG. 6C is an enlarged view illustrating the relationship between the upstream-side edge signal Su and the phase signal Sp before and after a fourth time point td, to be described later. The rolling speed Vr refers to the moving speed of the periphery of the measuring roller 110.

In a first period T1, which is before the recording sheet S enters the measuring device 100, the upstream-side edge signal Su and the downstream-side edge signal Sd are in an off state since the recording sheet S is not present. In the first period T1, the rolling speed Vr is zero since the measuring roller 110 is stopped, thereby maintaining the phase signal Sp and the Z-phase signal Sz in an off state. However, even when the measuring roller 110 is stopped, the phase signal Sp and the Z-phase signal Sz are sometimes maintained in an on state depending on the positions of the first slits 221 and the second slit 222 provided in the slit disk 220.

Subsequently, the upstream-side edge signal Su switches from the off state to an on state at a first time point ta, which is when the leading edge of the transported recording sheet S in the transport direction (simply referred to as "leading edge" hereinafter) reaches the detection position by the upstream-side detection sensor 160. At this time, because the downstream-side edge signal Sd is maintained in the off state and the measuring roller 110 is continuously in the stopped state (Vr=0), the phase signal Sp and the Z-phase signal Sz are also continuously maintained in the off state.

When the leading edge of the transported recording sheet S reaches an area opposite the measuring roller 110 at a second time point tb, which is when a second period T2 has elapsed since the first time point ta, the recording sheet S begins to rotationally drive the measuring roller 110. However, the rolling speed Vr of the measuring roller 110 does not immediately reach the recording-sheet transport speed Vs, but gradually increases toward the recording-sheet transport speed Vs. Because the slit disk 220 begins to rotate as the measuring roller 110 begins to rotate, the phase signal Sp repeatedly switches between the on state and the off state. However, because the rolling speed Vr gradually increases, as mentioned above, the interval between the on state and the off state of the phase signal Sp gradually becomes shorter.

The downstream-side edge signal Sd switches from the off state to the on state at the third time point tc, which is when a third period T3 has elapsed since the second time point tb and when the leading edge of the transported recording sheet S reaches the detection position by the downstream-side detection sensor 170. At this time, the upstream-side edge signal Su is maintained in the on state, and the rolling speed Vr of the measuring roller 110 is increased to the recording-sheet transport speed Vs before the third time point tc is reached. Therefore, the phase signal Sp repeatedly and periodically switches between the on state and the off state at least from the third time point tc onward. After the slit disk 220 starts rotating, the Z-phase signal Sz temporarily switches from the off state to the on state every time the slit disk 220 makes one rotation. FIG. 6A shows an example in which the Z-phase signal Sz does not switch to the on state in the second period T2, but switches to the on state for the first time after the third time point tc.

The upstream-side edge signal Su switches from the on state to the off state at the fourth time point td, which is when a fourth period T4 has elapsed since the third time point tc and when the trailing edge of the transported recording sheet S in the transport direction (simply referred to as "trailing edge" hereinafter) passes the detection position by the upstream-side detection sensor 160. At this time, the downstream-side edge signal Sd is maintained in the on state, and the rolling speed Vr of the measuring roller 110 is continuously maintained at the recording-sheet transport speed Vs. When the trailing edge of the transported recording sheet S passes the area opposite the measuring roller 110 at a fifth time point te, which is when a fifth period T5 has elapsed since the fourth time point td, the measuring roller 110 no longer receives a driving force from the recording sheet S. However, the rolling speed Vr of the measuring roller 110 does not immediately reach zero (is not immediately stopped), but gradually decreases from the recording-sheet transport speed Vs. Because the slit disk 220 is also reduced in speed as the driving of the measuring roller 110 is stopped, the interval between the on state and the off state of the phase signal Sp gradually becomes longer.

The downstream-side edge signal Sd switches from the on state to the off state at a sixth time point tf, which is when a sixth period T6 has elapsed since the fifth time point to and when the trailing edge of the transported recording sheet S passes the detection position by the downstream-side detection sensor 170. At this time, the upstream-side edge signal Su is maintained in the off state, and the rolling speed Vr of the measuring roller 110 becomes zero and stops before the sixth time point tf is reached. In a seventh period T7, which is after the recording sheet S is discharged from the measuring device 100, the upstream-side edge signal. Su and the downstream-side edge signal Sd switch to the off state since the recording sheet S is not present. Furthermore, because the measuring roller 110 is stopped from rotating in the seventh period T7, the rolling speed Vr is zero so that the phase signal Sp and the Z-phase signal Sz are also maintained in the off state. However, as mentioned above, the phase signal Sp and the Z-phase signal Sz are sometimes maintained in the on state even when the measuring roller 110 is stopped.

The third time point tc, which is when the downstream-side edge signal Sd switches from the off state to the on state, might not always coincide with the timing at which the phase signal Sp switches from the off state to the on state (referred to as "rise" hereinafter) or from the on state to the off state (referred to as "drop" hereinafter). In the following description, a period from the third time point tc to a downstream-shift time point tc0, which is when the phase signal Sp rises or drops for the first time immediately after the third time point tc, will be referred to as a downstream-shift period Tx, as shown in FIG. 6B. FIG. 6B shows an example in which the phase signal Sp drops at the downstream-shift time point tc0.

Furthermore, the fourth time point td, which is when the upstream-side edge signal Su switches from the on state to the off state, might not always coincide with the timing at which the phase signal Sp rises or drops. In the following description, a period from the fourth time point td to an upstream-shift time point td0, which is when the phase signal Sp rises or drops for the last time immediately before the fourth time point td, will be referred to as an upstream-shift period Ty, as shown in FIG. 6C. FIG. 6C shows an example in which the phase signal Sp drops at the upstream-shift time point td0.

Furthermore, in the fourth period T4 in which the single transported recording sheet S is detected by both the upstream-side detection sensor 160 and the downstream-side detection sensor 170, a period between the current on state of the Z-phase signal Sz and the subsequent on state of the Z-phase signal Sz will be referred to as a rotation period Tr in the following description. The rotation period Tr refers to a period for causing the slit disk 220 to make one rotation by causing the measuring roller 110, whose rolling speed Vr is set at the recording-sheet transport speed Vs, to make one rotation.

Figure 7:
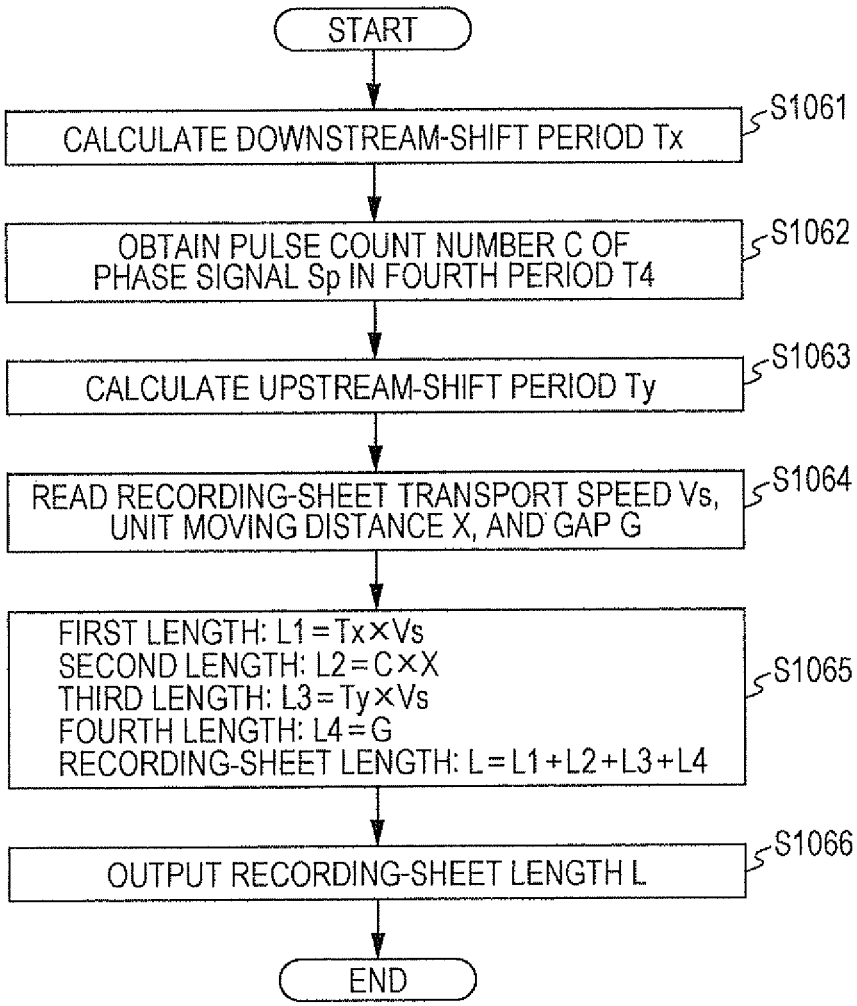
FIG. 7 is a flow chart illustrating an example of processing for calculating a recording-sheet length in a recording-sheet-length calculating unit shown in FIG. 4.
Figure 8:
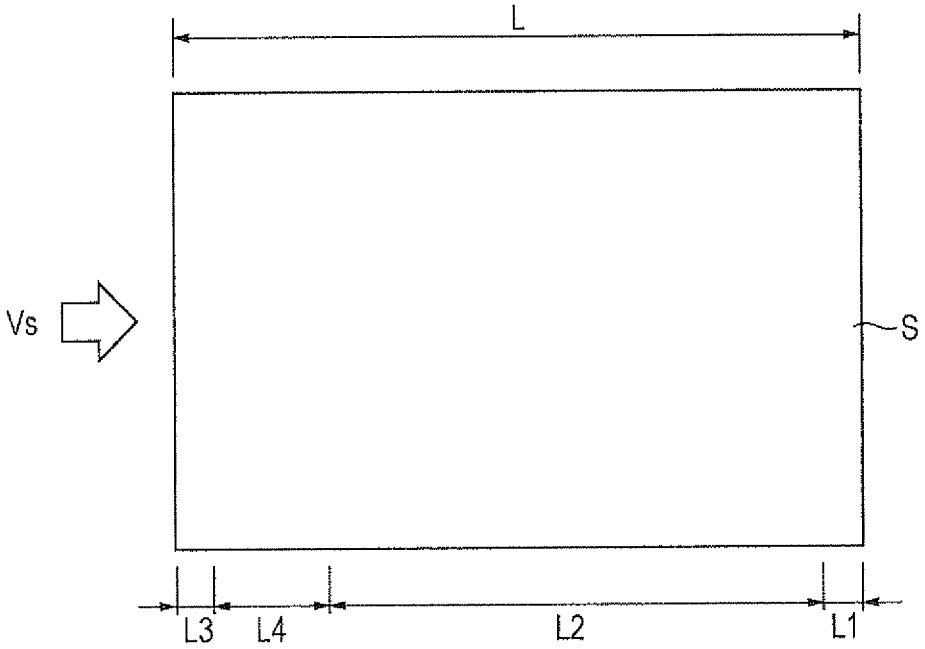
FIG. 8 illustrates the relationship between the recording-sheet length of the transported recording sheet and a first length, a second length, a third length, and a fourth length in the recording-sheet length.

FIG. 7 is a flow chart illustrating an example of processing for calculating the recording-sheet length L in the recording-sheet-length calculating unit 85 shown in FIG. 4. FIG. 8 illustrates the relationship between the recording-sheet length L of the transported recording sheet S, and a first length L1, a second length L2, a third length L3, and a fourth length L4 in the recording-sheet length L. The first length L1 to the fourth length L4 will be described in detail later.

The recording-sheet-length calculating unit 85 first obtains the third time point tc and the downstream-shift time point tc0 on the basis of the downstream-side edge signal Sd and the phase signal Sp, and calculates the downstream-shift period Tx on the basis of the third time point tc and the downstream-shift time point tc0 in step S1061. Then, the recording-sheet-length calculating unit 85 obtains the third time point tc and the fourth time point td on the basis of the upstream-side edge signal Su and the downstream-side edge signal Sd, obtains the fourth period T4 on the basis of the third time point tc and the fourth time point td, and then refers to the phase signal Sp so as to obtain a pulse count number C, which is the number of times the phase signal Sp rises within the fourth period T4, in step S1062.

Subsequently, the recording-sheet-length calculating unit 85 obtains the fourth time point td and the upstream-shift time point td0 on the basis of the upstream-side edge signal Su and the phase signal Sp, and obtains the upstream-shift period Ty on the basis of the fourth time point td and the upstream-shift time point td0 in step S1063. Then, in step S1064, the recording-sheet-length calculating unit 85 reads the recording-sheet transport speed Vs, the unit moving distance X, and the gap G from the coefficient storage unit 86. In this case, the recording-sheet-length calculating unit 85 reads the recording-sheet transport speed Vs in accordance with the type of recording sheet S whose length is to be measured.

Subsequently, the recording-sheet-length calculating unit 85 calculates the first length L1, the second length L2, the third length L3, and the fourth length L4, and calculates the recording-sheet length L by adding the obtained first length L1 to fourth length L4 together in step S1065. In this case, the first length L1 is obtained by multiplying the downstream-shift period Tx calculated in step S1061 by the recording-sheet transport speed Vs read in step S1064. The second length L2 is obtained by multiplying the pulse count number C obtained in step S1062 by the unit moving distance X read in step S1064. In this case, the second length L2 is equal to a length of the recording sheet S (i.e., a partial length of the recording sheet S) ascertained on the basis of how much the measuring roller 110 is rotated from when the leading edge of the recording sheet S is detected by the downstream-side detection sensor 170 to when the trailing edge of the recording sheet S is detected by the upstream-side detection sensor 160. The third length L3 is obtained by multiplying the upstream-shift period Ty obtained in step S1063 by the recording-sheet transport speed Vs read in step S1064. The fourth length L4 is equal to the gap G read in step S1064. In step S1066, the recording-sheet-length calculating unit 85 outputs the recording-sheet length L calculated in step S1065 to the image-signal output adjusting unit 83 and the operation control unit 84, thereby completing the series of processes.

The moving mechanism 300 illustrated in FIG. 2 will now be described in detail.

Figure 9B:
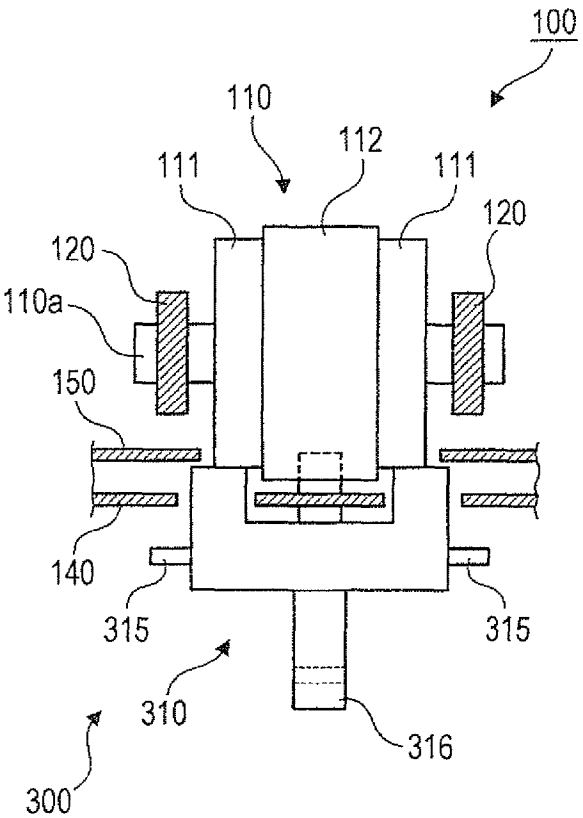
FIGS. 9A and 9B illustrate a moving mechanism.
Figure 9A:
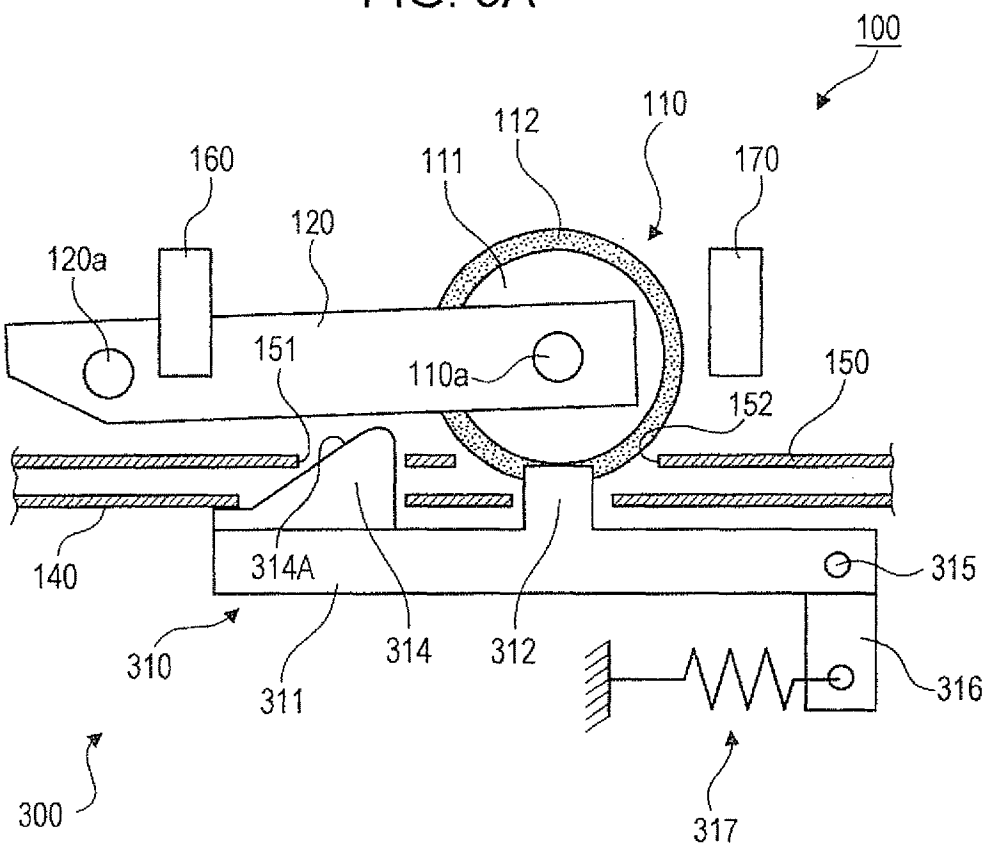
Figure 10A:
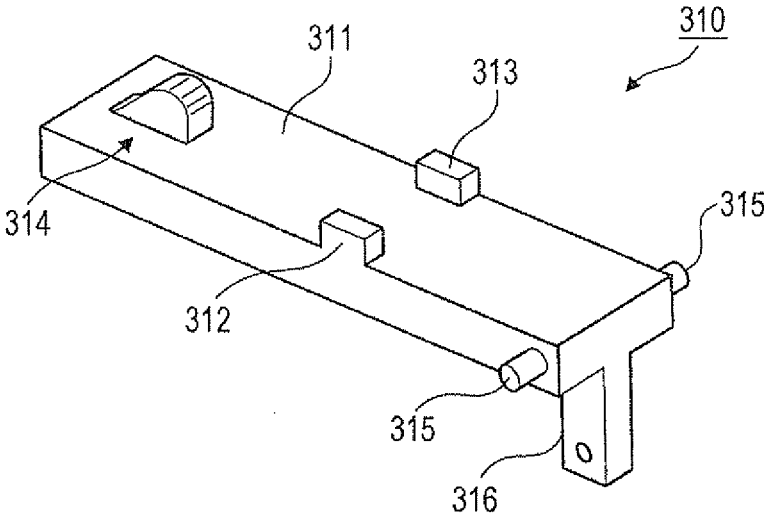
FIGS. 10A and 10B are perspective views illustrating a support member provided in the moving mechanism.
Figure 10B:
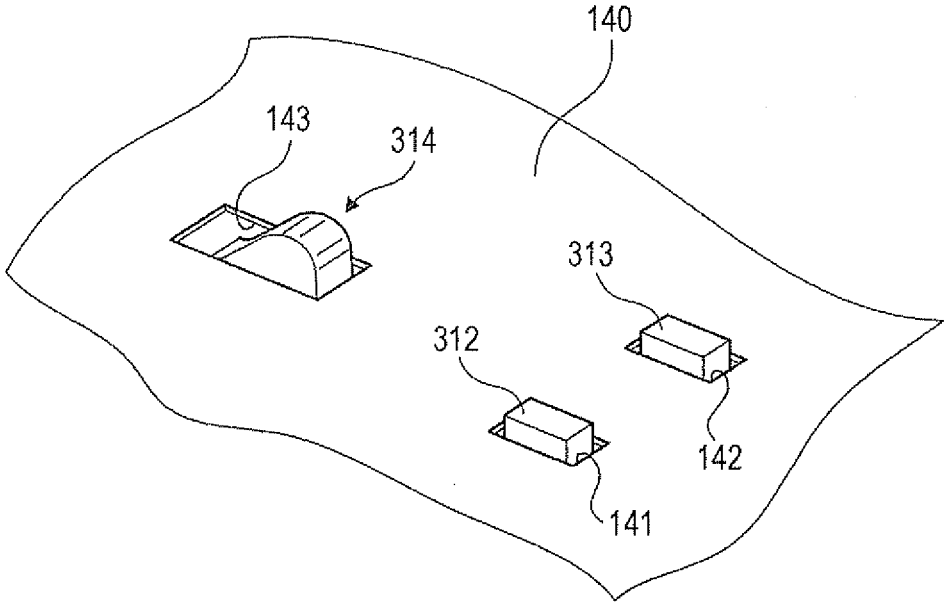
Figure 11:
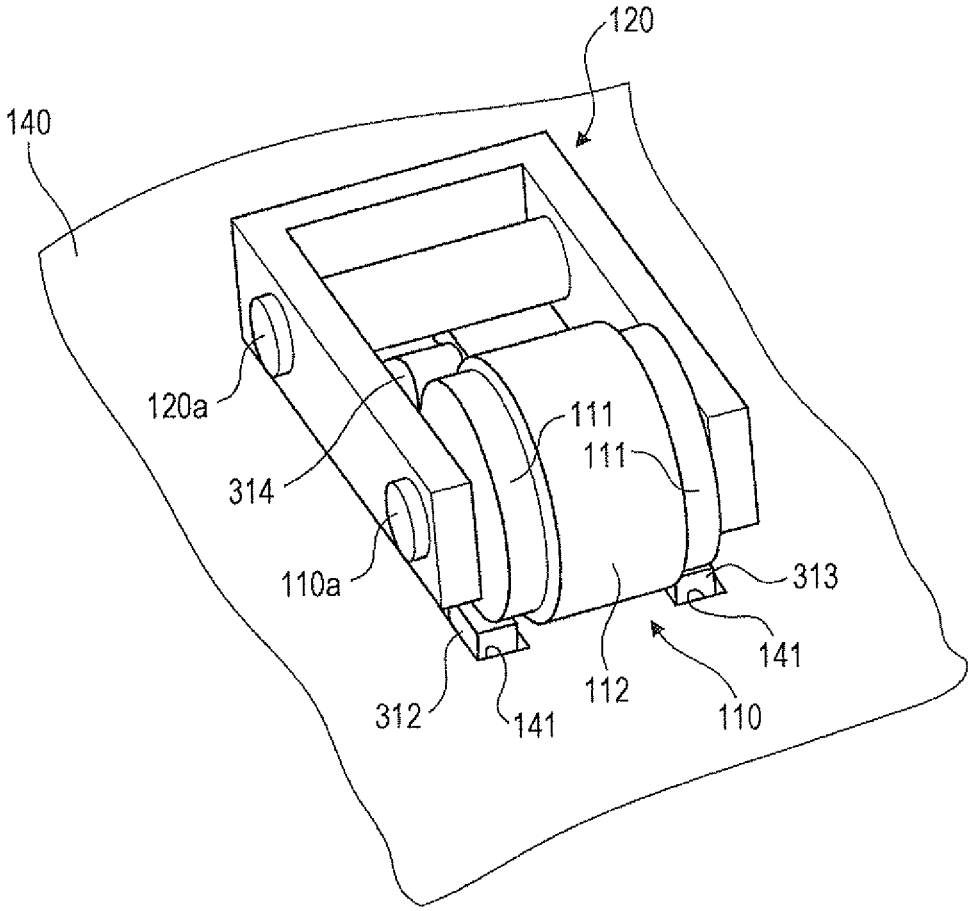
FIG. 11 is a perspective view of a measuring roller, etc.

FIGS. 9A and 9B illustrate the moving mechanism 300. FIG. 9B corresponds to when the moving mechanism 300 is viewed from the downstream side of the recording sheet S in the transport direction. FIGS. 10A and 10B are perspective views illustrating a support member 310 (to be described later) provided in the moving mechanism 300. FIG. 11 is a perspective view of the measuring roller 110, etc.

As shown in FIGS. 9A and 9B, in the moving mechanism 300 in this exemplary embodiment, the support member 310 that supports the measuring roller 110 from below is provided below the lower guide member 140 and extends in the transport direction of the recording sheet S. As shown in FIG. 10A, the support member 310 has a plate-like body portion 311, a first protrusion 312 and a second protrusion 313 that protrude from the upper surface of the body portion 311 and that support the measuring roller 110 from below. Furthermore, a third protrusion 314 that protrudes into the transport path 44 for the recording sheet S is provided upstream of the first protrusion 312 and the second protrusion 313 in the transport direction of the recording sheet S.

Although omitted in the above description, the surface layer 112 of the measuring roller 110 is provided at a central part of the measuring roller 110 in the lengthwise direction thereof, and the roller body 111 is exposed at the ends of the measuring roller 110, as shown in FIG. 11. The first protrusion 312 and the second protrusion 313 support areas of the measuring roller 110 where the roller body 111 is exposed. In other words, the outer peripheral surface of the measuring roller 110 is constituted of the outer peripheral surface of the surface layer 112 and the outer peripheral surface of the roller body 111. In this exemplary embodiment, the outer peripheral surface of the roller body 111 is supported by the first protrusion 312 and the second protrusion 313. The outer peripheral surface of the roller body 111 is located closer to the axis of the measuring roller 110 relative to the outer peripheral surface of the surface layer 112.

As shown in FIG. 9A, in this exemplary embodiment, the third protrusion 314 has a slope 314A at the upper surface thereof and extending upward toward the downstream side in the transport direction of the recording sheet S. In this exemplary embodiment, the recording sheet S transported to the slope 314A comes into contact therewith. Thus, a downward load is applied to an area of the support member 310 that is provided with the third protrusion 314, whereby this area is displaced downward.

Furthermore, as shown in FIGS. 9A and 9B, fourth protrusions 315 having a columnar shape are provided at opposite side surfaces of the body portion 311 at downstream positions of the support member 310 in the transport direction of the recording sheet S. The fourth protrusions 315 are rotatably supported by the housing (not shown) of the measuring device 100. Therefore, in this exemplary embodiment, the support member 310 is rotatable about the fourth protrusions 315. Furthermore, in this exemplary embodiment, a projection 316 projecting downward from the body portion 311 is provided at a downstream position of the support member 310 in the transport direction of the recording sheet S, as shown in FIGS. 9A and 9B. Moreover, a coil spring 317 that pulls the projection 316 upstream in the transport direction of the recording sheet S is also provided.

As shown in FIG. 10B, the first protrusion 312 and the second protrusion 313 respectively protrude upward through a first opening 141 and a second opening 142 formed in the lower guide member 140 so as to support the measuring roller 110 located above the lower guide member 140. The third protrusion 314 protrudes into the transport path 44 for the recording sheet S through a third opening 143 formed in the lower guide member 140. In this exemplary embodiment, the upper guide member 150 is also provided with an opening 151 (see FIG. 9A) so as to prevent interference between the third protrusion 314 and the upper guide member 150. The upper guide member 150 is further provided with an opening 152 for allowing the measuring roller 110 to come into contact with the recording sheet S (see FIG. 9A).

Next, the operation of the moving mechanism 300 will be described.

Figure 12B:
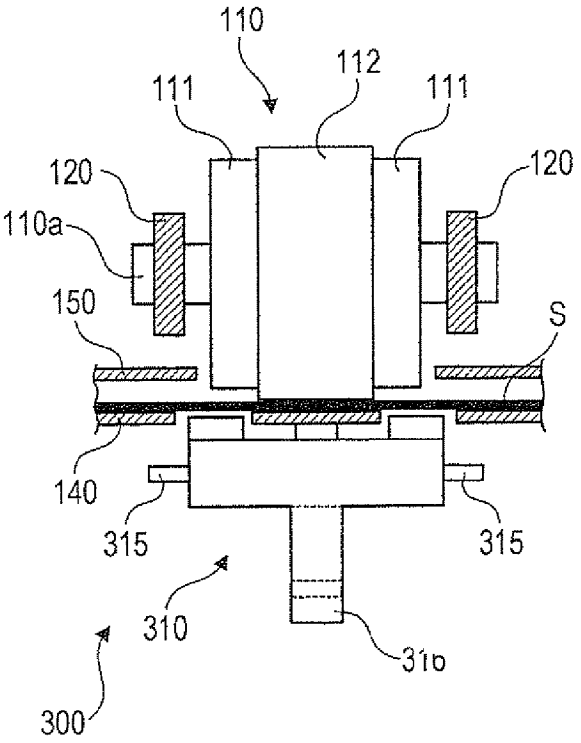
FIGS. 12A and 12B illustrate the operation of the moving mechanism.
Figure 12A:
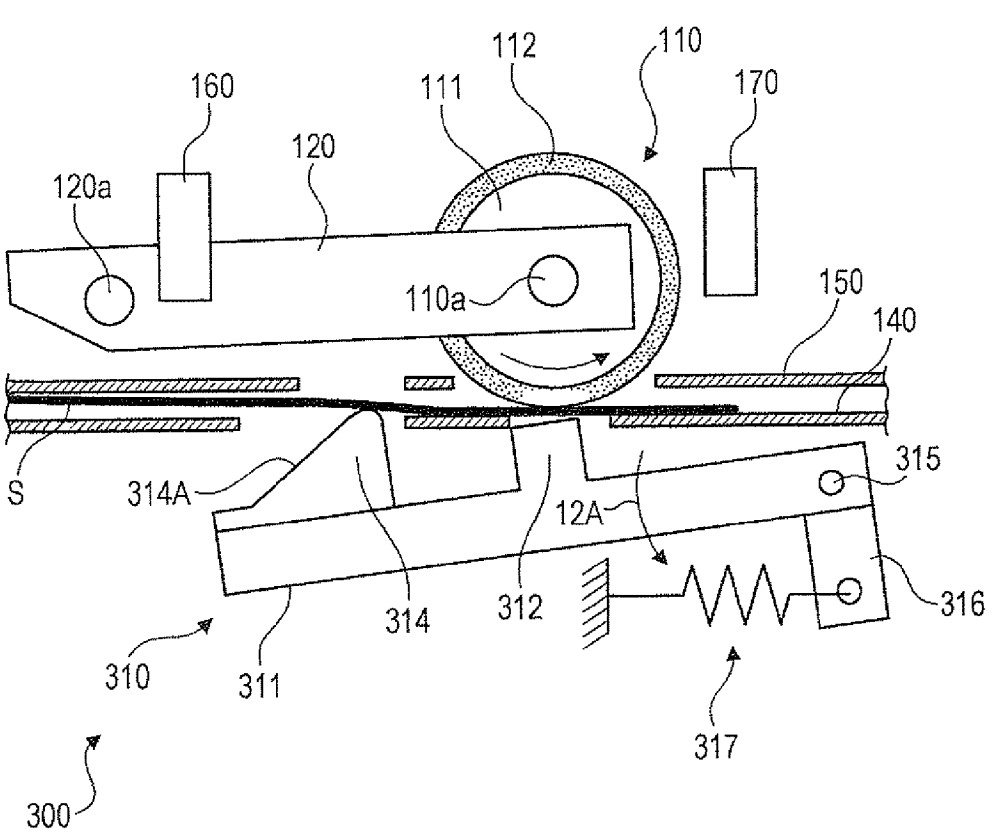

FIGS. 12A to 14B illustrate the operation of the moving mechanism 300. As shown in FIGS. 12A and 12B, when the recording sheet S is transported from upstream, the recording sheet S comes into contact with the slope 314A of the third protrusion 314 functioning as a displacement section. Thus, the third protrusion 314 is pressed by the recording sheet S so that a downward displacement force is applied to an upstream position of the support member 310 in the transport direction of the recording sheet S. As a result, the support member 310 rotates about the fourth protrusions 315 in a direction indicated by an arrow 12A (i.e., counterclockwise direction) in FIG. 12A.

The rotation of the support member 310 causes the first protrusion 312 and the second protrusion 313 (only the first protrusion 312 is shown in FIG. 12A) to be displaced downward. This displacement causes the measuring roller 110 to move downward, whereby the measuring roller 110 comes into contact with the lower guide member 140. Accordingly, in this exemplary embodiment, the downward movement of the measuring roller 110 is performed (i.e., the restriction of the movement of the measuring roller 110 is released) by utilizing the load applied from the recording sheet S to the third protrusion 314. Then, as shown in FIGS. 12A and 12B, the recording sheet S reaches the contact area between the measuring roller 110 and the lower guide member 140. Consequently, the measuring roller 110 starts to rotate.

Figure 13B:
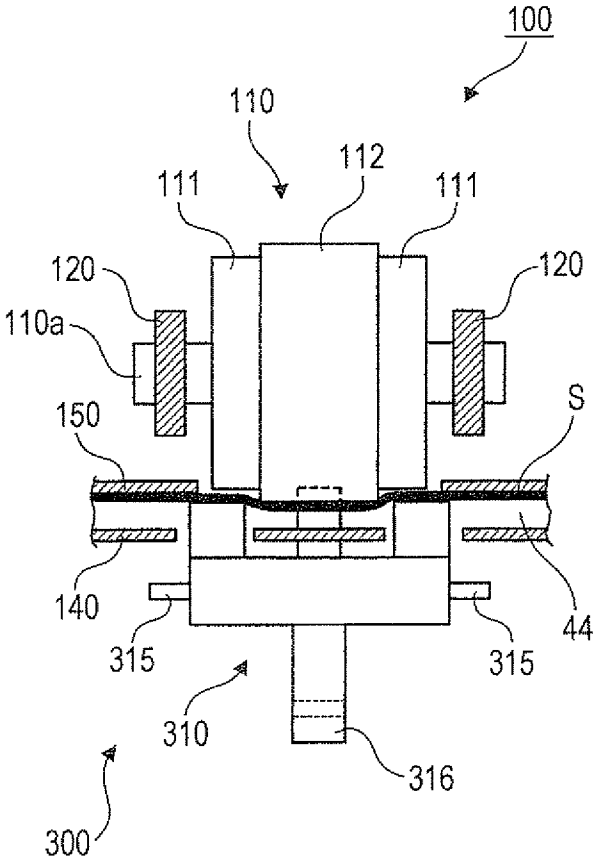
FIGS. 13A and 13B illustrate the operation of the moving mechanism.
Figure 13A:
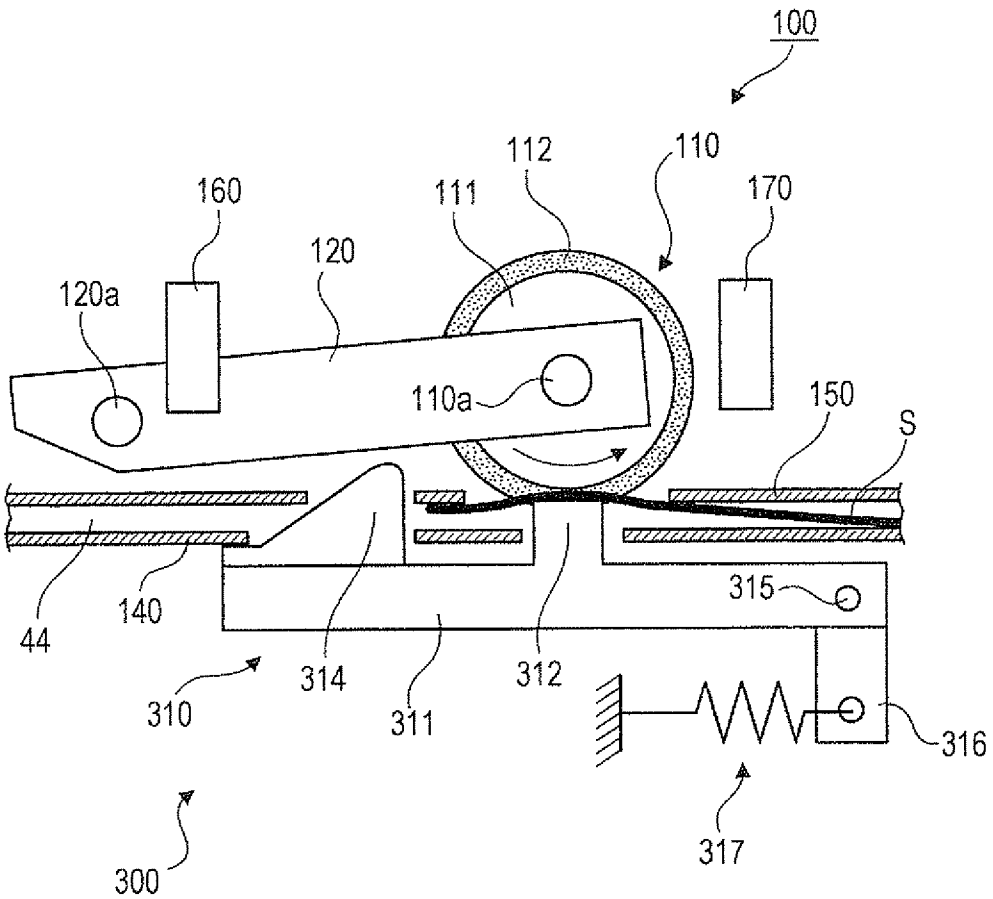

Subsequently, the recording sheet S is continuously transported, and when the trailing edge of the recording sheet S passes the third protrusion 314, as shown in FIG. 13A, the third protrusion 314 becomes capable of moving upward, whereby the support member 310 is rotated clockwise by the coil spring 317. Consequently, the third protrusion 314 protrudes again into the transport path 44 for the recording sheet S. Moreover, the first protrusion 312 and the second protrusion 313 are displaced upward. In other words, the first protrusion 312 and the second protrusion 313 functioning as restrictors are positioned on a movement path of the measuring roller 110. Thus, the measuring roller 110 moves upward. In other words, the measuring roller 110 moves away from the lower guide member 140. In this case, the recording sheet S is positioned between the measuring roller 110 and the first and second protrusions 312 and 313. Therefore, the measuring roller 110 rotationally follows the recording sheet S moving downstream.

Subsequently, as the recording sheet S moves further, a state where the recording sheet S is not present between the first protrusion 312 and the measuring roller 110 as well as between the second protrusion 313 and the measuring roller 110 is achieved (see FIGS. 14A and 14B). After the recording sheet S passes through between the first protrusion 312 and the measuring roller 110 and between the second protrusion 313 and the measuring roller 110, the measuring roller 110 continues to rotate due to inertia, but eventually stops rotating. In this case, the measuring roller 110 is supported from below by the first protrusion 312 and the second protrusion 313 and is positioned away from the lower guide member 140. Moreover, since the outer peripheral surface of the roller body 111 is in contact with the first protrusion 312 and the second protrusion 313, the measuring roller 110 is stopped from rotating.

As described above, in the measuring device 100 in this exemplary embodiment, the measuring roller 110 rotationally follows the recording sheet S. After the recording sheet S passes the measuring roller 110, the measuring roller 110 continues to rotate due to inertia. When the recording sheet S passes the measuring roller 110, the continuously rotating measuring roller 110 moves toward the lower guide member 140 and comes into contact with the lower guide member 140. In this case, abrasion may occur in the measuring roller 110, which tends to result in a reduced outside diameter of the measuring roller 110. This may shorten the life span of the measuring roller 110. In particular, if a surface layer (e.g., the surface layer 112 made of an elastic member, such as rubber, in this exemplary embodiment) having lower abrasion resistance than the roller body 111 is necessary around the outer peripheral surface of the measuring roller 110 to prevent slippage against the recording sheet S, the problem may become prominent. Therefore, in this exemplary embodiment, the moving mechanism 300 is provided so as to prevent the rotating measuring roller 110 from being in contact with the lower guide member 140 after the recording sheet S passes the measuring roller 110.

Figure 14B:
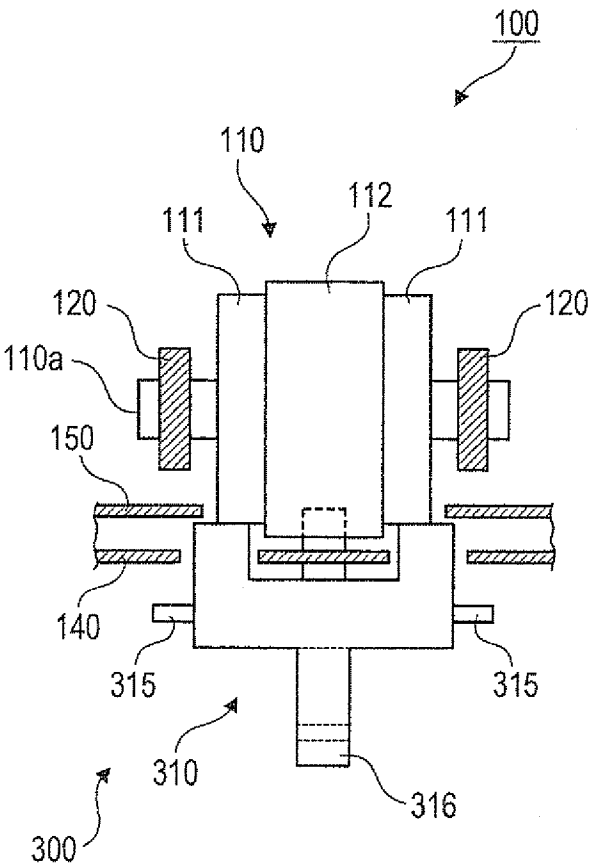
FIGS. 14A and 14B illustrate the operation of the moving mechanism.
Figure 14A:
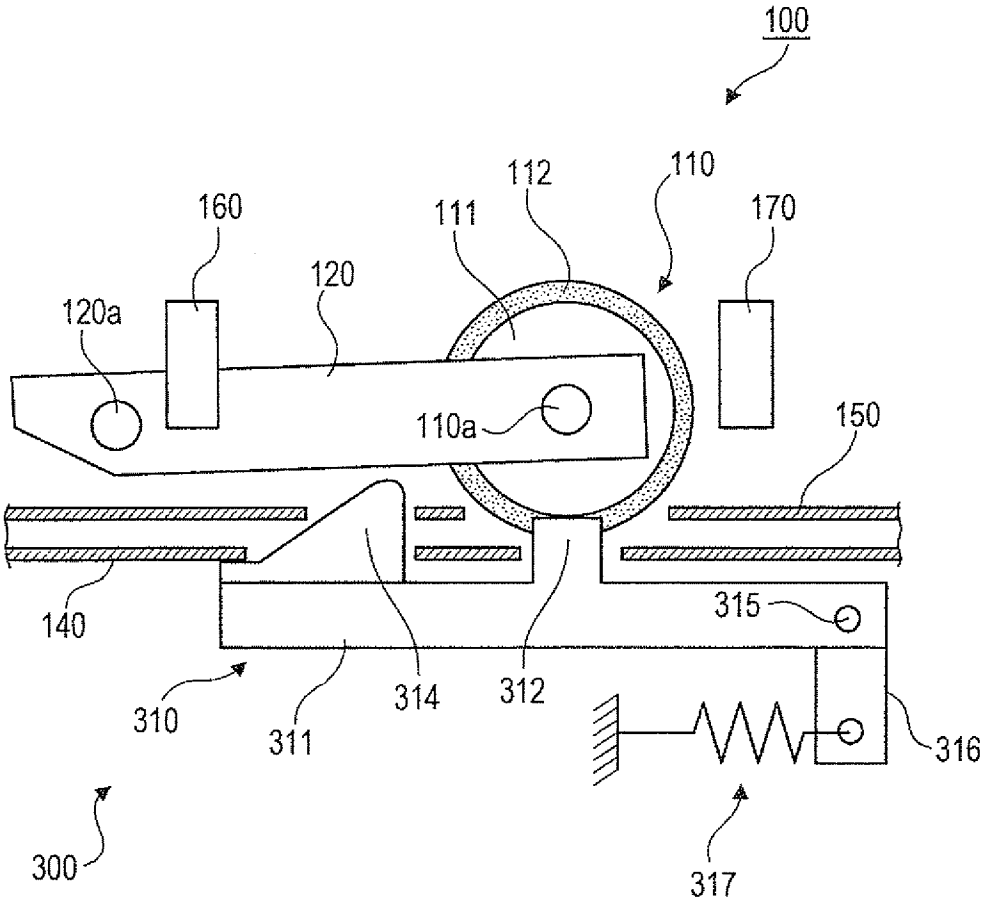

When a new recording sheet S is transported from the state shown in FIGS. 14A and 14B, the operation shown in FIGS. 12A to 14B is repeated. More specifically, the third protrusion 314 is pressed by the transported recording sheet S so that the first protrusion 312 and the second protrusion 313 functioning as restrictors move away from the transport path 44 for the recording sheet S. Thus, the restriction of the movement of the measuring roller 110 is released, causing the measuring roller 110 to move toward the lower guide member 140. Then, the recording sheet S passing through between the measuring roller 110 and the lower guide member 140 rotates the measuring roller 110. Finally, the first protrusion 312 and the second protrusion 313 move upward when the recording sheet S has passed the third protrusion 314. Thus, the outer peripheral surface of the roller body 111 of the measuring roller 110 becomes supported by the first protrusion 312 and the second protrusion 313, so that the measuring roller 110 is positioned away from the lower guide member 140. Although the outer peripheral surface of the roller body 111 is in contact with the first protrusion 312 and the second protrusion 313 while the measuring roller 110 continues to rotate, the abrasion occurring in this case is minimized as compared with the abrasion caused when the surface layer 112 is in contact with the lower guide member 140. Moreover, since the outer peripheral surface of the roller body 111 is not directly in contact with the recording sheet S, the length measuring accuracy is not affected even if the abrasion does occur.

Figure 15B:
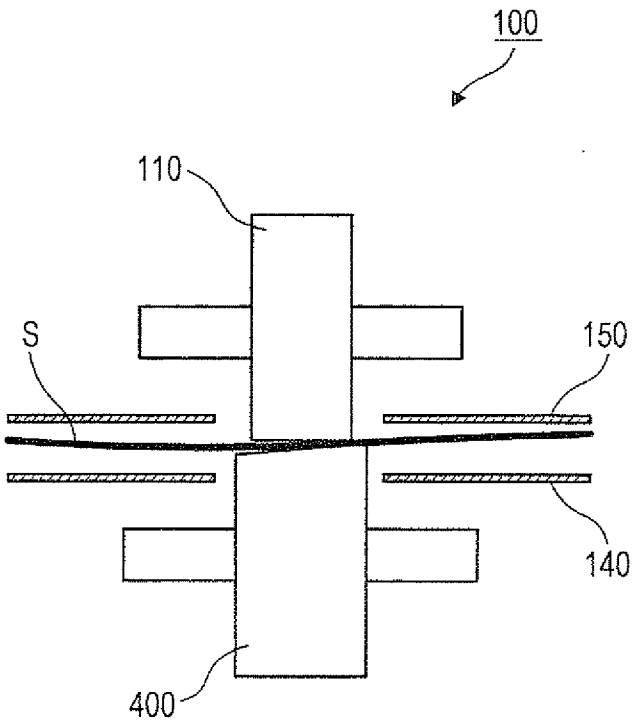
FIGS. 15A and 15B illustrate another exemplary embodiment of the measuring device.
Figure 15A:
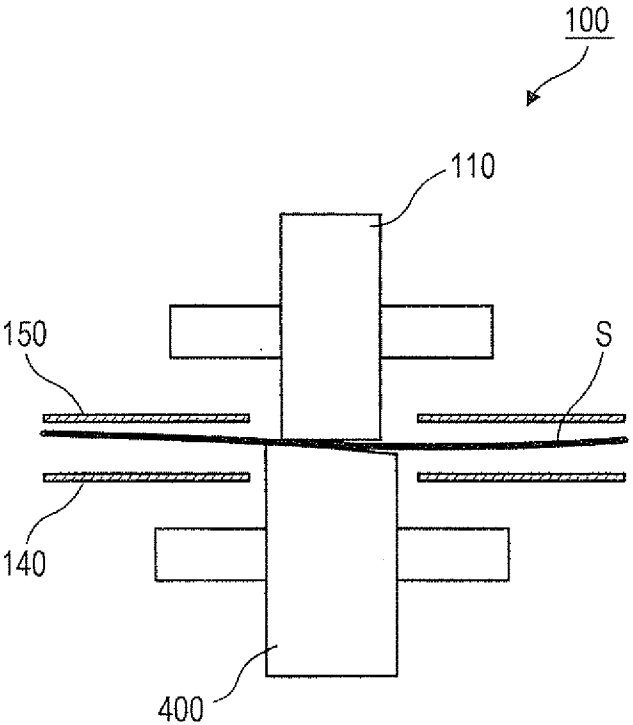

As shown in FIGS. 15A and 15B (illustrating another exemplary embodiment of the measuring device 100), a rotatable roller member 400 may be provided in place of the fixed lower guide member 140. With this configuration, because the roller member 400 rotates at the same speed as the measuring roller 110 after the recording sheet S passes the measuring roller 110, abrasion of the measuring roller 110 is less likely to occur. In the case where such a roller member 400 is used, eccentricity of the roller member 400 is unavoidable. The eccentricity can cause the measuring roller 110 to fluctuate easily. Such a fluctuation can lead to a fluctuation in the contact load between the measuring roller 110 and the recording sheet S or to unstable rotational following properties of the measuring roller 110 relative to the recording sheet S. In this case, the length measuring performance tends to become lower.

Furthermore, as shown in FIGS. 15A and 15B, the outside diameter of the roller member 400 may vary from place to place depending on how well the periphery of the roller member 400 is made. In this case, the outside diameter of the measuring roller 110 may also vary, resulting in lower length measuring performance. Therefore, in this exemplary embodiment, the lower guide member 140 having a flat upper surface is used as a component facing the measuring roller 110. In this case, however, because the measuring roller 110 may become readily abraded, the measuring roller 110 is moved by using the moving mechanism 300 in this exemplary embodiment, as described above.

Figure 16A:
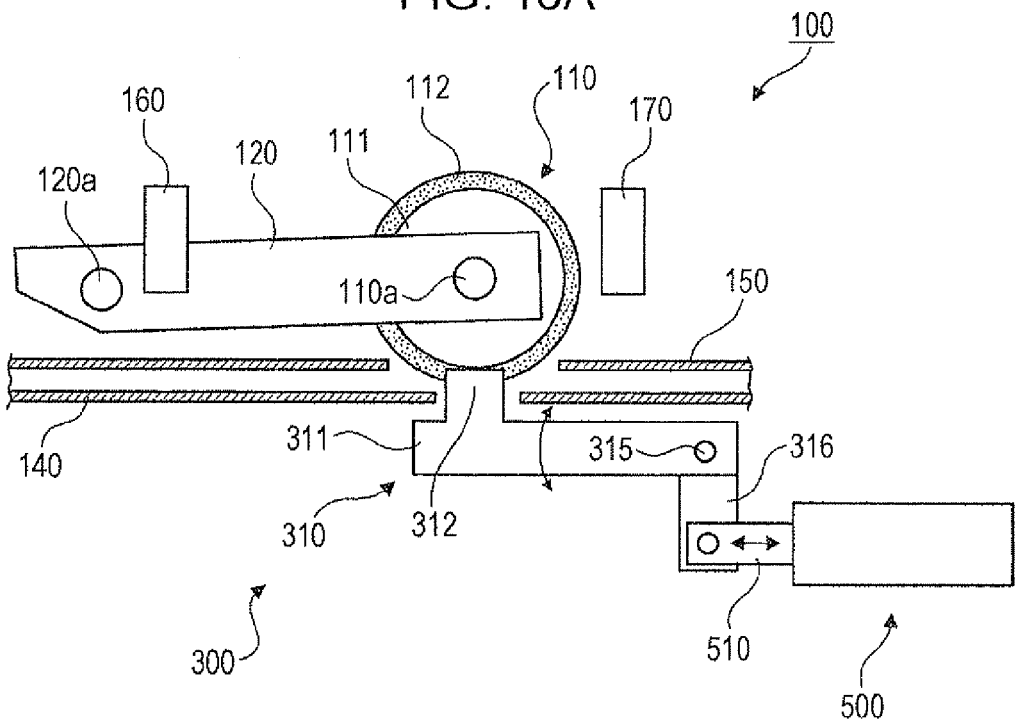
FIGS. 16A and 16B illustrate another configuration example of the measuring device.
Figure 16B:
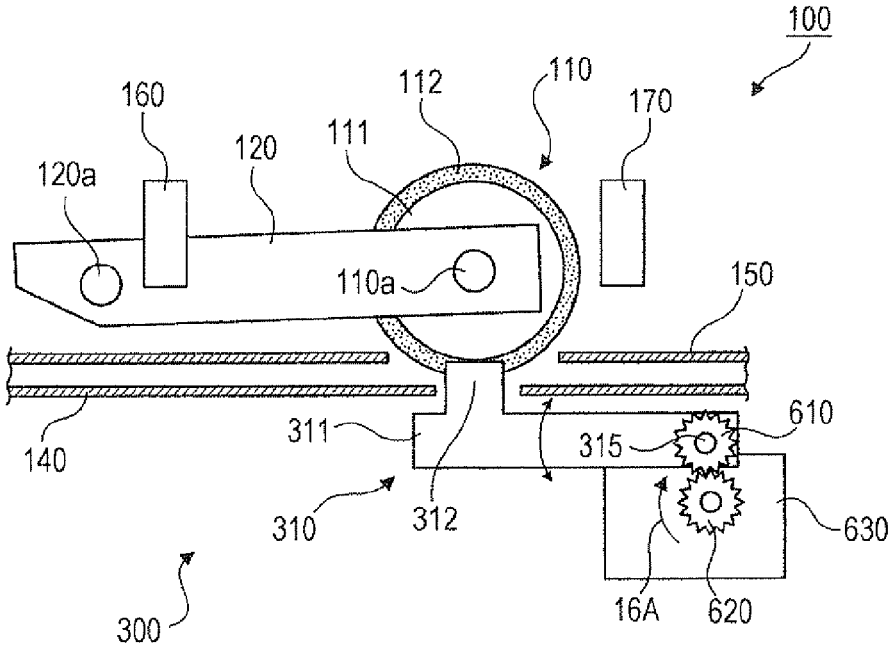

FIGS. 16A and 16B illustrate another configuration example of the measuring device 100.

In the measuring device 100 shown in FIG. 16A, the measuring roller 110 is moved by using a solenoid 500. More specifically, a plunger 510 of the solenoid 500 is fixed to the projection 316 of the support member 310. In this exemplary embodiment, the plunger 510 moves in the transport direction of the recording sheet S so as to move the measuring roller 110. More specifically, for example, by moving the plunger 510 rightward by turning on the solenoid 500, the first protrusion 312 and the second protrusion 313 move downward, causing the measuring roller 110 to move toward the lower guide member 140. On the other hand, for example, by moving the plunger 510 leftward by turning off the solenoid 500, the first protrusion 312 and the second protrusion 313 move upward, causing the measuring roller 110 to move upward.

The solenoid 500 can be turned off (i.e., the measuring roller 110 can be moved upward) when the trailing edge of the recording sheet S is detected by the upstream-side detection sensor 160. In other words, the solenoid 500 can be turned off by using the detection of the trailing edge of the recording sheet S by the upstream-side detection sensor 160 as a trigger signal. On the other hand, the measuring roller 110 can be moved toward the lower guide member 140 (i.e., the solenoid 500 can be turned on) when the leading edge of the recording sheet S is detected by the upstream-side detection sensor 160. In other words, the solenoid 500 can be turned on by using the detection of the leading edge of the recording sheet S by the upstream-side detection sensor 160 as a trigger signal.

As another alternative, the measuring device 100 may have a configuration as shown in FIG. 16B. In the measuring device 100 in this exemplary embodiment, first gears 610 are attached to the fourth protrusions 315 of the support member 310. Furthermore, a driving motor 630 and second gears 620 that transmit a rotational driving force from the driving motor 630 to the first gears 610 are also provided. In the configuration in this exemplary embodiment, the first protrusion 312 and the second protrusion 313 are moved downward by driving the driving motor 630 and rotating the second gears 620 in a direction indicated by an arrow 16A, whereby the measuring roller 110 moves toward the lower guide member 140. Furthermore, the first protrusion 312 and the second protrusion 313 are moved upward by rotating the driving motor 630 in the reverse direction, whereby the measuring roller 110 moves upward. Similar to the above, the upward movement of the measuring roller 110 can be performed when the trailing edge of the recording sheet S is detected by the upstream-side detection sensor 160. The downward movement of the measuring roller 110 can be performed when the leading edge of the recording sheet S is detected by the upstream-side detection sensor 160.

Although the measuring roller 110 is directly lifted (moved) upward by using the first protrusion 312 and the second protrusion 313 in the above description, a moving section that moves in conjunction with the movement of the measuring roller 110 may be lifted upward as an alternative. Examples of the moving section include the pivot arm 120 and the rotary shaft 110*a*. Although the measuring roller 110 is supported at two locations from below by using the first protrusion 312 and the second protrusion 313 in the above description, the measuring roller 110 may alternatively be supported at a single location.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image forming unit that forms an image on a recording sheet;

a transport unit that transports the recording sheet on which the image is formed by the image forming unit;

a support surface that supports the recording sheet transported by the transport unit;

a rotating member that has an outer peripheral surface moved toward the support surface when the recording sheet passes through between the support surface and the outer peripheral surface and that rotationally follows the recording sheet when the recording sheet passes through between the support surface and the outer peripheral surface;

an ascertaining unit that ascertains a length of the recording sheet on the basis of an amount of rotation of the rotating member; and a restricting unit that restricts a movement of the rotating member that moves toward the support surface, and moves the rotating member away from the support surface after the recording sheet passes through between the support surface and the outer peripheral surface of the rotating member.

2. The image forming apparatus according to claim 1, wherein the restricting unit releases the restriction and moves the rotating member toward the support surface when a new recording sheet is transported.

3. The image forming apparatus according to claim 2, further comprising a displacement section that protrudes into a transport path for the new recording sheet and that is pressed and displaced by the transported new recording sheet, wherein the restricting unit releases the restriction by utilizing a load received from the new recording sheet by the displacement section.

4. The image forming apparatus according to claim 3, further comprising:

a first detector that is provided downstream of the rotating member in a transport direction of the recording sheet and that detects a leading edge of the recording sheet; and a second detector that is provided upstream of the rotating member in the transport direction of the recording sheet and that detects a trailing edge of the recording sheet, wherein the ascertaining unit ascertains the amount of rotation of the rotating member from when the leading edge is detected by the first detector to when the trailing edge is detected by the second detector, and ascertains a partial length of the recording sheet using the ascertained amount of rotation, wherein the restricting unit causes a restrictor that restricts the movement of the rotating member to be positioned on a movement path of the rotating member or a moving section, which moves in conjunction with the movement of the rotating member, when the trailing edge of the recording sheet reaches a predetermined location upstream of the rotating member, and wherein the restricting unit uses the restrictor to restrict the movement of the rotating member that moves toward the support surface after the recording sheet passes through between the support surface and the outer peripheral surface of the rotating member, and wherein an output from the second detector is used for determining whether or not the trailing edge of the recording sheet has reached the predetermined location.

5. The image forming apparatus according to claim 3, wherein the outer peripheral surface of the rotating member is provided with a first peripheral surface that comes into contact with the recording sheet, and a second peripheral surface that is located closer to an axis of the rotating member relative to the first peripheral surface, and wherein the restricting unit restricts the movement by coming into contact with the second peripheral surface of the rotating member.

6. The image forming apparatus according to claim 2, further comprising:

a first detector that is provided downstream of the rotating member in a transport direction of the recording sheet and that detects a leading edge of the recording sheet; and a second detector that is provided upstream of the rotating member in the transport direction of the recording sheet and that detects a trailing edge of the recording sheet, wherein the ascertaining unit ascertains the amount of rotation of the rotating member from when the leading edge is detected by the first detector to when the trailing edge is detected by the second detector, and ascertains a partial length of the recording sheet using the ascertained amount of rotation, wherein the restricting unit causes a restrictor that restricts the movement of the rotating member to be positioned on a movement path of the rotating member or a moving section, which moves in conjunction with the movement of the rotating member, when the trailing edge of the recording sheet reaches a predetermined location upstream of the rotating member, and wherein the restricting unit uses the restrictor to restrict the movement of the rotating member that moves toward the support surface after the recording sheet passes through between the support surface and the outer peripheral surface of the rotating member, and wherein an output from the second detector is used for determining whether or not the trailing edge of the recording sheet has reached the predetermined location.

7. The image forming apparatus according to claim 2, wherein the outer peripheral surface of the rotating member is provided with a first peripheral surface that comes into contact with the recording sheet, and a second peripheral surface that is located closer to an axis of the rotating member relative to the first peripheral surface, and wherein the restricting unit restricts the movement by coming into contact with the second peripheral surface of the rotating member.

8. The image forming apparatus according to claim 1, further comprising:

a first detector that is provided downstream of the rotating member in a transport direction of the recording sheet and that detects a leading edge of the recording sheet; and a second detector that is provided upstream of the rotating member in the transport direction of the recording sheet and that detects a trailing edge of the recording sheet, wherein the ascertaining unit ascertains the amount of rotation of the rotating member from when the leading edge is detected by the first detector to when the trailing edge is detected by the second detector, and ascertains a partial length of the recording sheet using the ascertained amount of rotation, wherein the restricting unit causes a restrictor that restricts the movement of the rotating member to be positioned on a movement path of the rotating member or a moving section, which moves in conjunction with the movement of the rotating member, when the trailing edge of the recording sheet reaches a predetermined location upstream of the rotating member, and wherein the restricting unit uses the restrictor to restrict the movement of the rotating member that moves toward the support surface after the recording sheet passes through between the support surface and the outer peripheral surface of the rotating member, and wherein an output from the second detector is used for determining whether or not the trailing edge of the recording sheet has reached the predetermined location.

9. The image forming apparatus according to claim 8, wherein the restricting unit moves the rotating member toward the support surface by moving the restrictor away from the movement path when a leading edge of a newly transported recording sheet reaches the predetermined location upstream of the rotating member, and wherein the output from the second detector is used for determining whether or not the leading edge of the newly transported recording sheet has reached the predetermined location.

10. The image forming apparatus according to claim 9, wherein the outer peripheral surface of the rotating member is provided with a first peripheral surface that comes into contact with the recording sheet, and a second peripheral surface that is located closer to an axis of the rotating member relative to the first peripheral surface, and wherein the restricting unit restricts the movement by coming into contact with the second peripheral surface of the rotating member.

11. The image forming apparatus according to claim 8, wherein the outer peripheral surface of the rotating member is provided with a first peripheral surface that comes into contact with the recording sheet, and a second peripheral surface that is located closer to an axis of the rotating member relative to the first peripheral surface, and wherein the restricting unit restricts the movement by coming into contact with the second peripheral surface of the rotating member.

12. The image forming apparatus according to claim 1, wherein the outer peripheral surface of the rotating member is provided with a first peripheral surface that comes into contact with the recording sheet, and a second peripheral surface that is located closer to an axis of the rotating member relative to the first peripheral surface, and wherein the restricting unit restricts the movement by coming into contact with the second peripheral surface of the rotating member.

13. The image forming apparatus according to claim 1, wherein the restricting unit prevents the outer peripheral surface of the rotating member, which comes into contact with the recording sheet, from coming into contact with the support member.

14. A length measuring device comprising:

a support surface that supports a transported object;

a rotating member that is used for measuring a length of the transported object, the rotating member having an outer peripheral surface that is moved toward the support surface when the recording sheet passes through between the support surface and the outer peripheral surface and rotationally following the transported object when the transported object passes through between the support surface and the outer peripheral surface; and a restricting unit that restricts a movement of the rotating member that moves toward the support surface, and moves the rotating member away from the support surface after the transported object passes.

* * * * *